US008926726B2

(12) United States Patent
Mitsuda

(10) Patent No.: US 8,926,726 B2
(45) Date of Patent: Jan. 6, 2015

(54) EXHAUST GAS PURIFICATION DEVICE

(75) Inventor: Masataka Mitsuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 13/580,787

(22) PCT Filed: Feb. 24, 2011

(86) PCT No.: PCT/JP2011/054172

§ 371 (c)(1),
(2), (4) Date: Aug. 29, 2012

(87) PCT Pub. No.: WO2011/114857

PCT Pub. Date: Sep. 22, 2011

(65) Prior Publication Data

US 2012/0311984 A1 Dec. 13, 2012

(30) Foreign Application Priority Data

Mar. 17, 2010 (JP) ..... 2010-060959

(51) Int. Cl.

| | |
|---|---|
| ***B01D 50/00*** | (2006.01) |
| ***B01D 39/20*** | (2006.01) |
| ***B01D 39/14*** | (2006.01) |
| ***B01D 39/06*** | (2006.01) |
| ***B01D 24/00*** | (2006.01) |
| ***B01D 59/50*** | (2006.01) |
| ***F01N 13/00*** | (2010.01) |
| ***F01N 13/18*** | (2010.01) |

(52) U.S. Cl.

CPC ..... *F01N 13/00* (2013.01); *F01N 13/008* (2013.01); *F01N 13/1805* (2013.01); *F01N 13/1838* (2013.01)

USPC ..... 55/523; 55/522; 55/524; 55/330; 422/169; 422/170; 422/171; 422/172; 422/177; 422/178; 422/179; 422/180; 422/181; 422/182

(58) Field of Classification Search

CPC .. F01N 13/1805; F01N 13/1838; F01N 13/00

USPC ..... 55/522–524, 330; 422/169–172, 422/177–182

See application file for complete search history.

(56) References Cited

U.S. PATENT DOCUMENTS 3,169,844 A * 2/1965 Young ..... 55/498
4,006,000 A * 2/1977 Tortorici et al. ..... 55/323

(Continued)

FOREIGN PATENT DOCUMENTS

JP 2001-073748 3/2001
JP 2003-120277 4/2003

(Continued)

*Primary Examiner* — Amber Orlando
(74) *Attorney, Agent, or Firm* — Jordan and Hamburg LLP

(57) ABSTRACT

A exhaust gas purification device is structured such that it is possible to improve an assembling work ability or a maintenance work ability of gas purifying bodies or exhaust gas purifying cases. In an exhaust gas purification device provided with gas purifying bodies which purify an exhaust gas discharged by an engine, and a gas purifying housing which is provided with the gas purifying bodies therein, the exhaust gas purification device is structured such that a support bracket which supports the gas purifying housing is provided, a bolt hole is formed in the support bracket, an insertion guide is formed in the support bracket, and an attaching bolt is engaged with and disengaged from the bolt hole via the insertion guide.

5 Claims, 21 Drawing Sheets

(56) References Cited

U.S. PATENT DOCUMENTS

| | | | | |
|---|---|---|---|---|
| 4,704,143 | A * | 11/1987 | Percy | 96/421 |
| 5,013,182 | A * | 5/1991 | Coulvonvaux et al. | 403/30 |
| 5,277,157 | A * | 1/1994 | Teich | 123/198 E |
| 5,293,743 | A * | 3/1994 | Usleman et al. | 60/299 |
| 5,921,214 | A * | 7/1999 | Fujita et al. | 123/198 E |
| 6,096,108 | A * | 8/2000 | Coulonvaux et al. | 55/385.3 |
| 6,641,636 | B2 * | 11/2003 | Willig et al. | 55/385.3 |
| 8,052,780 | B2 * | 11/2011 | Rotter et al. | 95/273 |
| 8,419,834 | B2 * | 4/2013 | Rotter et al. | 95/268 |
| 2003/0041833 | A1 | 3/2003 | Carpenter | |
| 2003/0159436 | A1 | 8/2003 | Foster | |
| 2007/0079794 | A1 * | 4/2007 | Rotter et al. | 123/198 E |

FOREIGN PATENT DOCUMENTS

| | | |
|---|---|---|
| JP | 2003-129910 | 5/2003 |
| JP | 2004-263593 | 9/2004 |
| JP | 2005-194949 | 7/2005 |
| JP | 2008-062865 | 3/2008 |
| JP | 2009-091982 | 4/2009 |
| JP | 2009-228516 | 10/2009 |
| WO | WO-2010/026864 | 3/2010 |

* cited by examiner

EXHAUST GAS PURIFICATION DEVICE

BACKGROUND OF THE INVENTION

The present invention relates to an exhaust gas purification device which is mounted to a diesel engine or the like, and more particularly to an exhaust gas purification device which removes a particulate matter (a soot and a particulate) and the like which are included in an exhaust gas.

Conventionally, there has been known a technique in which a diesel particulate filter (hereinafter, referred to as DPF) is provided in an exhaust route of a diesel engine as an exhaust gas purification device (an after treatment device), and purifies an exhaust gas which is discharged from the diesel engine by an oxidation catalyst of the DPF or a soot filter (refer, for example, to Patent Documents 1 and 2).

Further, in the DPF, there has been also known a technique of providing a temperature sensor which detects a temperature of an exhaust gas discharged from a diesel engine, and a pressure sensor which detects a pressure of the exhaust gas discharged from the diesel engine (refer, for example, to the Patent Document 2).

Further, in the DPF, there has been known a technique in which an inside case is provided as a double structure in an inner portion of an outside case, and is provided with an oxidation catalyst or a soot filter in the inside case (refer, for example, to Patent Document 3) therein.

Further, in the DPF, there has been known a technique in which a case having an oxidation catalyst therein and a case having a soot filter therein are coupled so as to be separable via a flange which is fastened by a bolt (refer, for example, to Patent Documents 4 and 5).

CITATION LIST

Patent Document 1: Japanese Unexamined Patent Publication No. 2004-263593

Patent Document 2: Japanese Unexamined Patent Publication No. 2001-73748

Patent Document 3: Japanese Unexamined Patent Publication No. 2005-194949

Patent Document 4: Japanese Unexamined Patent Publication No. 2009-228516

Patent Document 5: Japanese Unexamined Patent Publication No. 2009-91982

SUMMARY OF THE INVENTION

In the prior art, in the case that the DPF is assembled in an engine or a machine body side, in a state in which one worker lifts up the DPF by both hands so as to support in a predetermined state, it is necessary for another worker to fasten the attaching bolt so as to fix the DPF. Therefore, there is such a problem that it is impossible to reduce an assembling man hour of the DPF.

On the other hand, one worker can fasten the attaching bolt so as to fix the DPF to the engine or the machine body side by lifting up the DPF by utilizing a lifting machine such as a chain block or the like, however, it is limited to a work in a place in which the lifting machine is installed. It is impossible to easily shorten an attaching and detaching time of the DPF. In other words, there is such a problem that it is impossible to improve an assembling workability or a maintenance workability of the DPF.

Accordingly, the present invention intends to provide an exhaust gas purification device to which an improvement is applied by making a study of these actual conditions.

According to a first aspect of the present invention, there is provided an exhaust gas purification device including:

a gas purifying body which purifies an exhaust gas discharged by an engine; and a gas purifying housing which is provided with the gas purifying body therein, wherein the exhaust gas purification device is provided with a support bracket which supports the gas purifying housing, a bolt hole is formed in the support bracket, an insertion guide is formed in the support bracket, and an attaching bolt is engaged with and disengaged from the bolt hole via the insertion guide.

According to a second aspect of the present invention, in the exhaust gas purification device described in the first aspect, the insertion guide is formed by a bolt inserting notch which is provided in the support bracket, the bolt hole is left open to a side edge of the support bracket via the bolt inserting notch, the bolt hole is engaged with the attaching bolt in a temporally fixed state via the bolt inserting notch, and the gas purifying housing is structured such as to be supportable via the attaching bolt in the temporally fixed state.

According to a third aspect of the present invention, in the exhaust gas purification device described in the first aspect, an outside case body is fitted to an outer side of an exhaust gas purifying case which is provided with the gas purifying body therein, the gas purifying housing is formed by the exhaust gas purifying case and the outside case body, and the support bracket is firmly fixed to the outside case body integrally.

According to a fourth aspect of the present invention, in the exhaust gas purification device described in the third aspect, plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket is firmly fixed to at least any one of the plurality of outside case bodies integrally.

According to a fifth aspect of the present invention, in the exhaust gas purification device described in the third aspect, plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket in which the insertion guide is formed is firmly fixed to the outside case body in a side in which a dimension in an exhaust gas moving direction is longer, in the plurality of outside case bodies.

According to a sixth aspect of the present invention, in the exhaust gas purification device described in the third aspect, plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket in which the insertion guide is formed is firmly fixed to the outside case body in which an exhaust gas inlet pipe is provided, in the plurality of outside case bodies.

According to the first aspect of the present invention, in the exhaust gas purification device which is provided with the gas purifying body which purifies the exhaust gas discharged by an engine, and the gas purifying housing which is provided with the gas purifying body therein, the exhaust gas purification device is provided with the support bracket which supports the gas purifying housing, the bolt hole is formed in the support bracket, the insertion guide is formed in the support bracket, and the attaching bolt is engaged with and disengaged from the bolt hole via the insertion guide. Accordingly, after installing the attaching bolt for the temporally fixing to the attaching position in the engine side or the main machine side to which the support bracket is connected in a pre-set state, the bolt hole can be engaged with the attaching bolt via the insertion guide, and the gas purifying housing can be supported to the attaching position. In other words, the worker can fasten the attaching bolt for an after attaching so as to fasten the support bracket in a state of releasing hands from the gas purifying housing. It is possible to carry out an attaching and detaching work of the gas purifying housing by one worker. It is possible to improve an assembling workability of the gas purifying housing which is a heavy load.

According to the second aspect of the present invention, the insertion guide is formed by the bolt inserting notch which is provided in the support bracket, the bolt hole is left open to the side edge of the support bracket via the bolt inserting notch, the bolt hole is engaged with the attaching bolt in the temporally fixed state via the bolt inserting notch, and the gas purifying housing is structured such as to be supportable via the attaching bolt in the temporally fixed state. Accordingly, it is possible to engage the bolt hole with the attaching bolt which is temporarily fixed in the pre-set state via the bolt inserting notch. In other words, the worker can fasten the attaching bolt for an after attaching so as to fasten the support bracket in a state of releasing hands from the gas purifying housing. It is possible to carry out an attaching and detaching work of the gas purifying housing by one worker. It is possible to improve an assembling workability of the gas purifying housing which is a heavy load.

According to the third aspect of the present invention, the outside case body is fitted to the outer side of the exhaust gas purifying case which is provided with the gas purifying body therein, the gas purifying housing is formed by the exhaust gas purifying case and the outside case body, and the support bracket is firmly fixed to the outside case body integrally. Accordingly, it is possible to easily achieve a thermal insulation of the exhaust gas purifying case and an improvement of a rigidity of the gas purifying housing, by the outside case body.

According to the fourth aspect of the present invention, the plural sets of the gas purifying bodies, the exhaust gas purifying cases and the outside case bodies are provided, the flange body for connecting the plurality of outside case bodies is offset with respect to the connection boundary position of the plurality of the gas purifying bodies, and the support bracket is firmly fixed to at least any one of the plurality of outside case bodies integrally. Accordingly, it is possible to simplify a disassembling and assembling work of the gas purifying body and the exhaust gas purifying case. It is possible to easily prevent the exhaust gas leakage or the like by the flange body while it is possible to improve a maintenance workability of a soot clogging removal of the gas purifying body or the like.

According to the fifth aspect of the present invention, the plural sets of the gas purifying bodies, the exhaust gas purifying cases and the outside case bodies are provided, the flange body for connecting the plurality of outside case bodies is offset with respect to the connection boundary position of the plurality of the gas purifying bodies, and the support bracket in which the insertion guide is formed is firmly fixed to the outside case body in the side in which the dimension in the exhaust gas moving direction is longer, in the plurality of outside case bodies. Accordingly, it is possible to simplify a disassembling and assembling work of the gas purifying body and the exhaust gas purifying case. It is possible to easily prevent the exhaust gas leakage or the like by the flange body while it is possible to improve a maintenance workability of a soot clogging removal of the gas purifying body or the like. Further, it is possible to assemble the support bracket in which the insertion guide is formed with a high rigidity, by utilizing the outside case body which is formed longer.

According to the sixth aspect of the present invention, the plural sets of the gas purifying bodies, the exhaust gas purifying cases and the outside case bodies are provided, the flange body for connecting the plurality of outside case bodies is offset with respect to the connection boundary position of the plurality of the gas purifying bodies, and the support bracket in which the insertion guide is formed is firmly fixed to the outside case body in which the exhaust gas inlet pipe is provided, in the plurality of outside case bodies. Accordingly, it is possible to simplify a disassembling and assembling work of the gas purifying body and the exhaust gas purifying case. It is possible to easily prevent the exhaust gas leakage or the like by the flange body while it is possible to improve a maintenance workability of a soot clogging removal of the gas purifying body or the like. Further, it is possible to assemble the support bracket in which the insertion guide is formed, and the exhaust gas inlet pipe with a high rigidity, by utilizing the outside case body which is formed longer.

DESCRIPTION OF THE PREFERRED EMBODIMENTS

A description will be given below of a first embodiment of an exhaust gas purification device obtained by embodying the present invention on the basis of the accompanying drawings with reference to FIG. 1 to FIG. 13. It is provided with a continuous regeneration type diesel particulate filter 1 (hereinafter, referred to as DPF 1) as an exhaust gas purification device. It is structured such that the DPF 1 reduces a carbon monoxide (CO) and a hydro carbon (HC) in an exhaust gas of a diesel engine 70, in addition to a removal of a particulate matter (PM) in the exhaust gas of the diesel engine 70.

Figure 1:
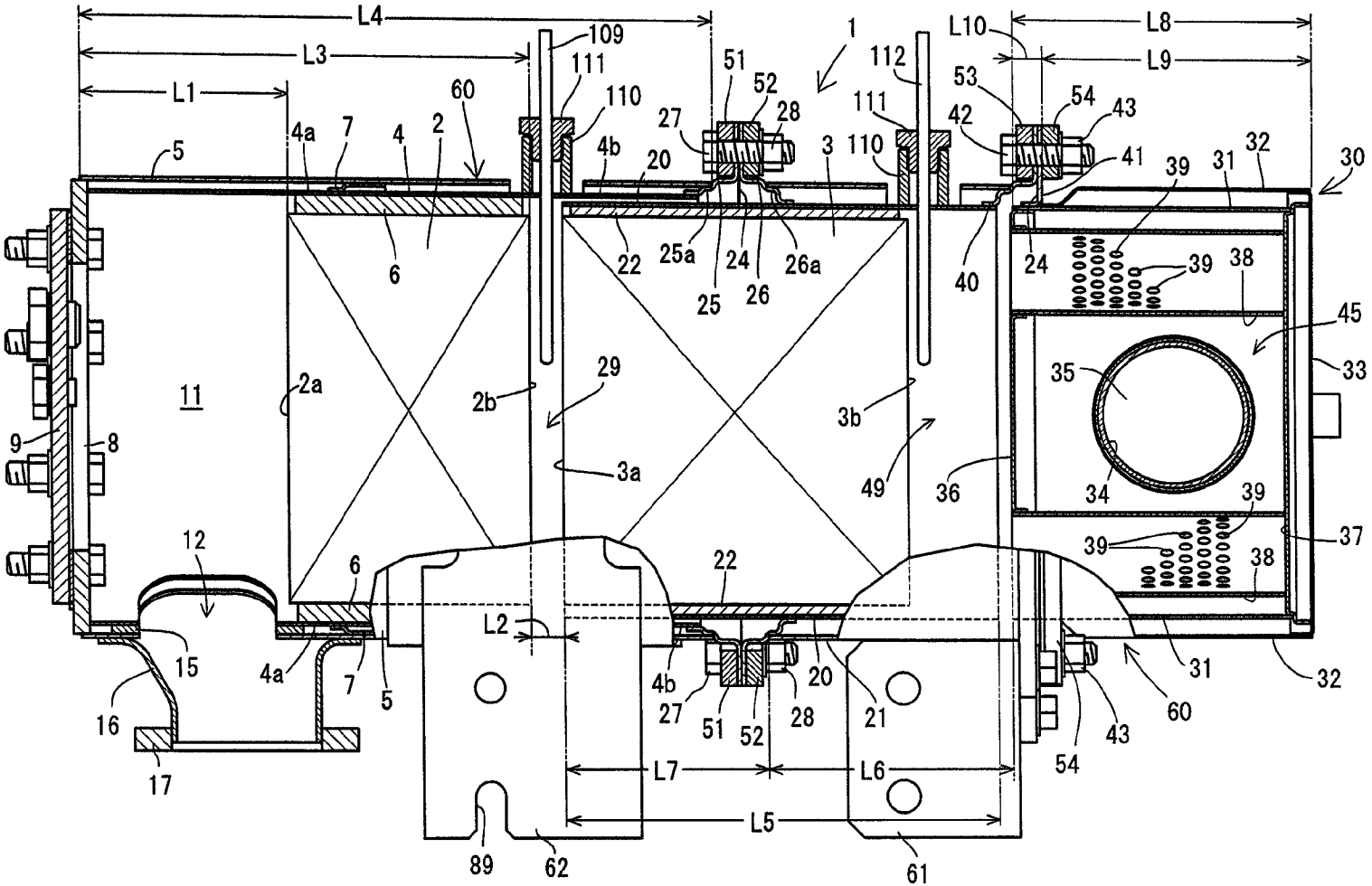
FIG. 1 is a cross sectional explanatory view of a DPF and shows a first embodiment.
Figure 2:
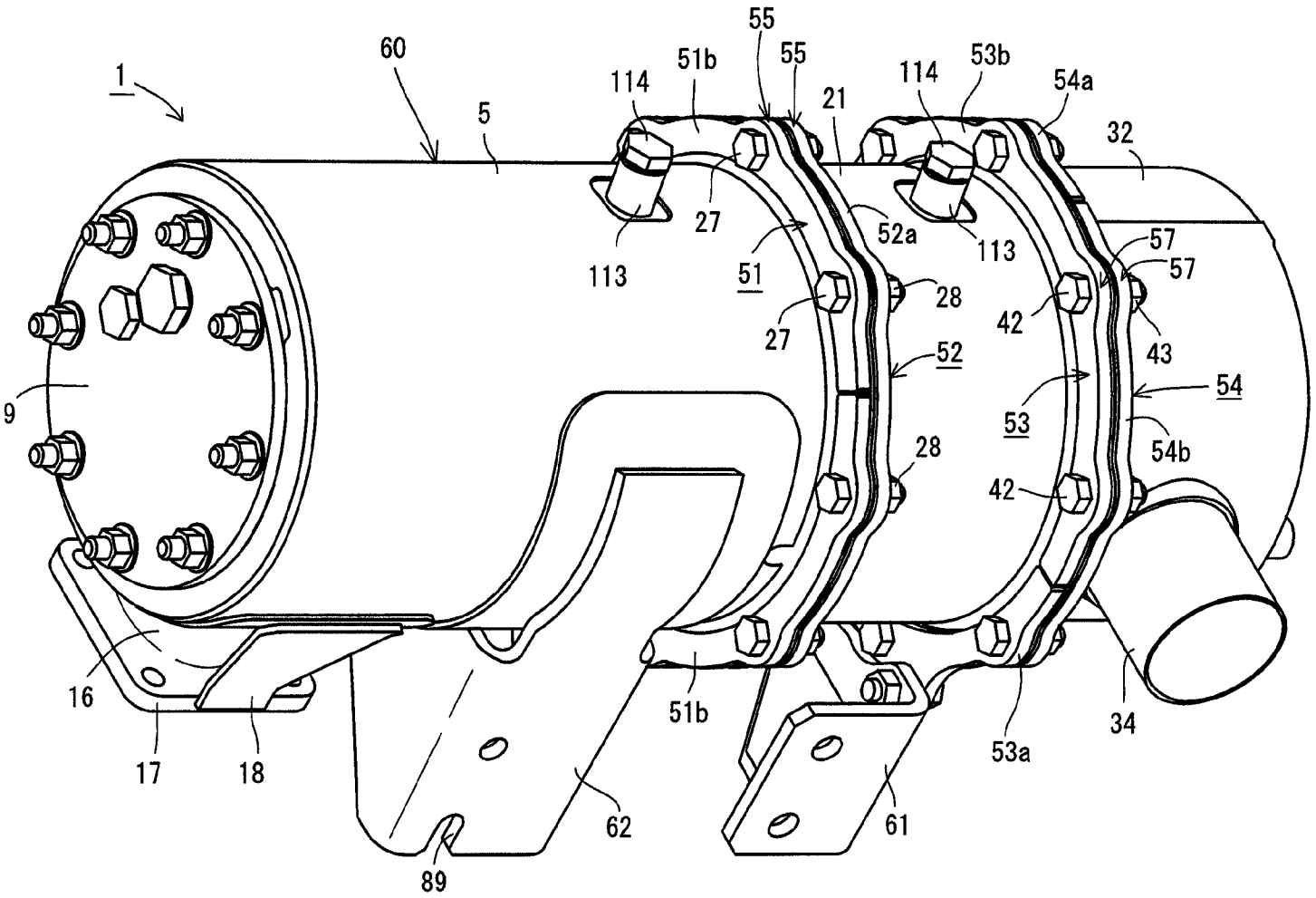
FIG. 2 is a perspective view of an outer appearance of the DPF.
Figure 3:
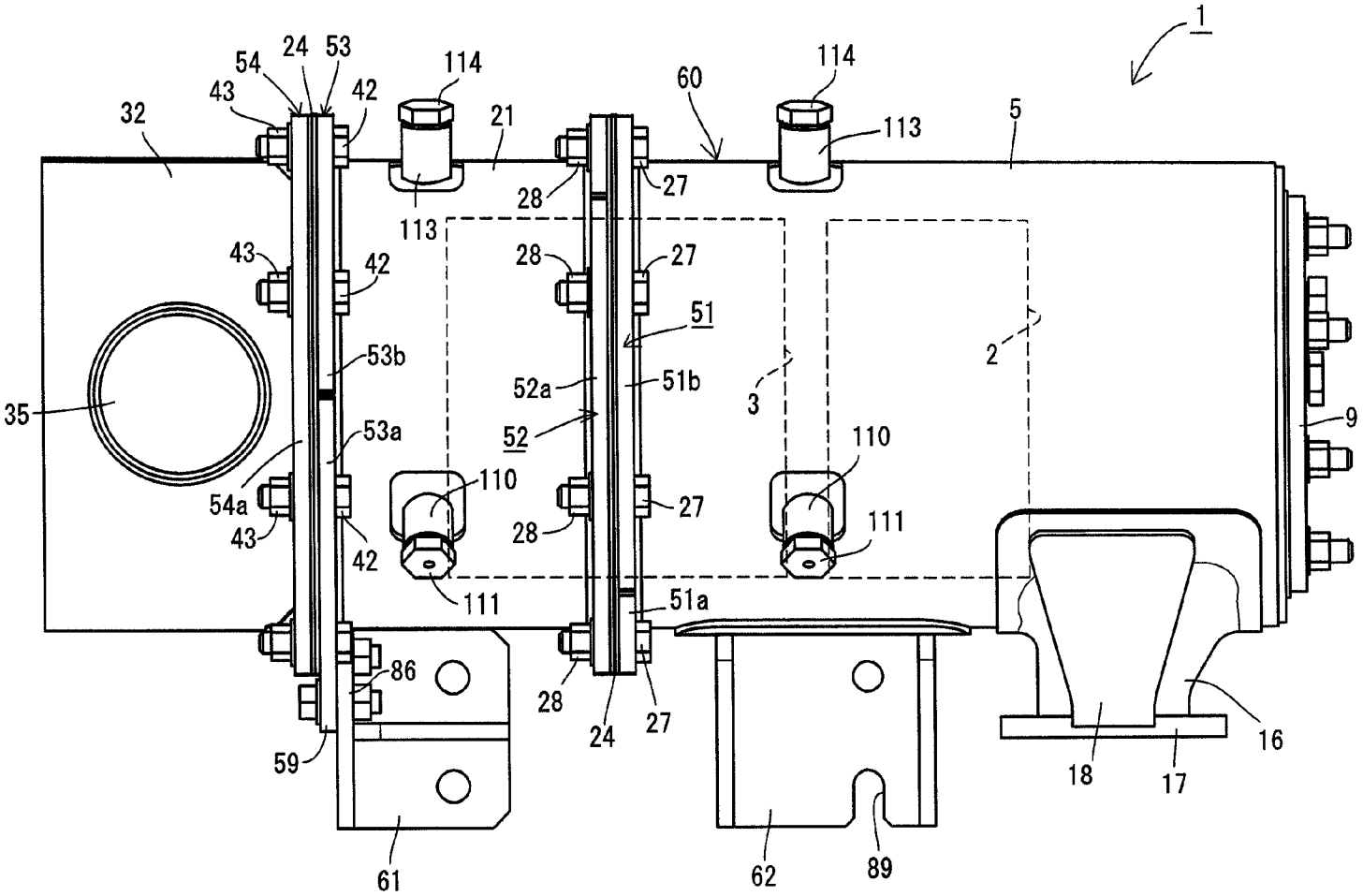
FIG. 3 is a plan view of the outer appearance of the DPF.
Figure 4:
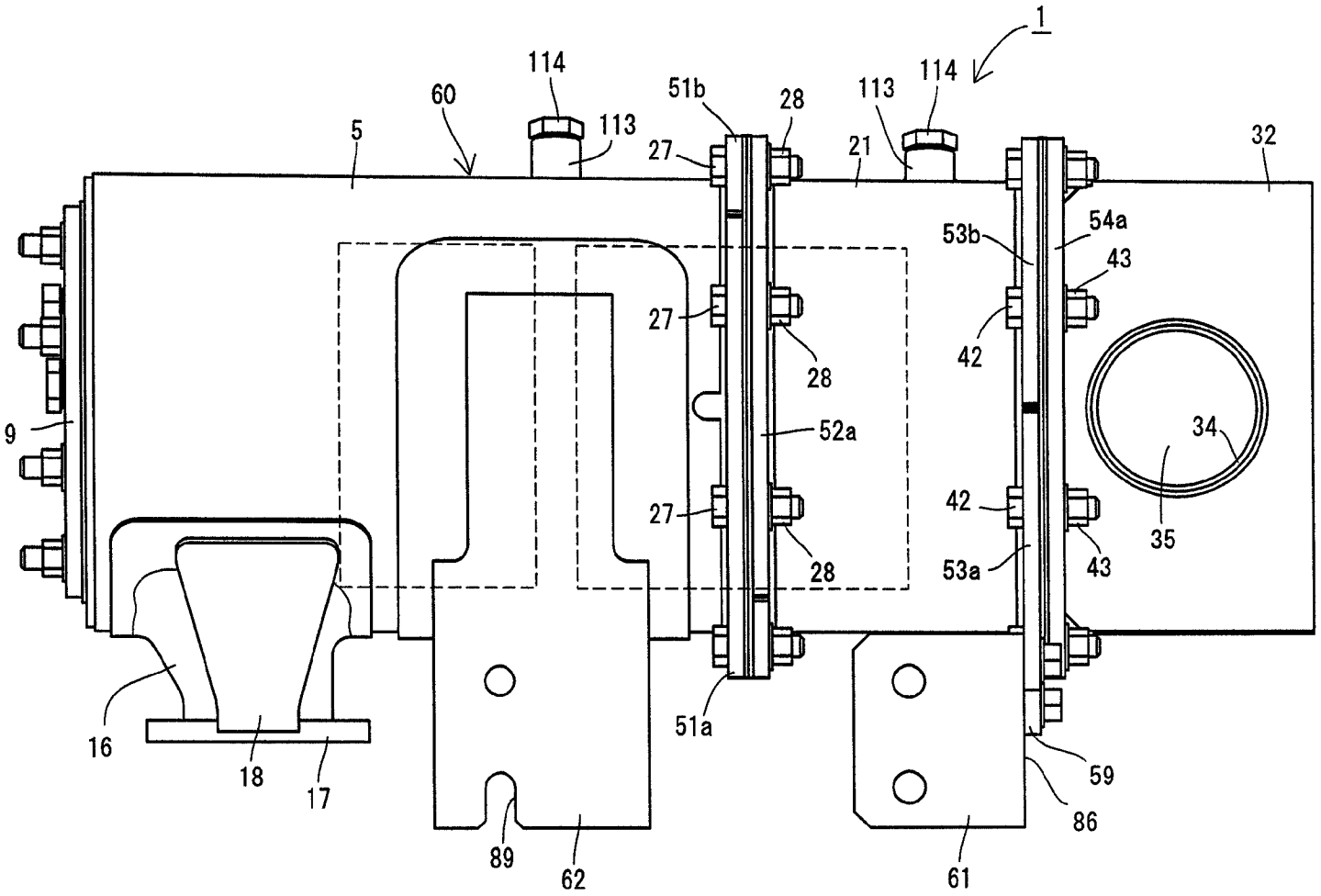
FIG. 4 is a bottom elevational view of the outer appearance of the DPF.
Figure 5:
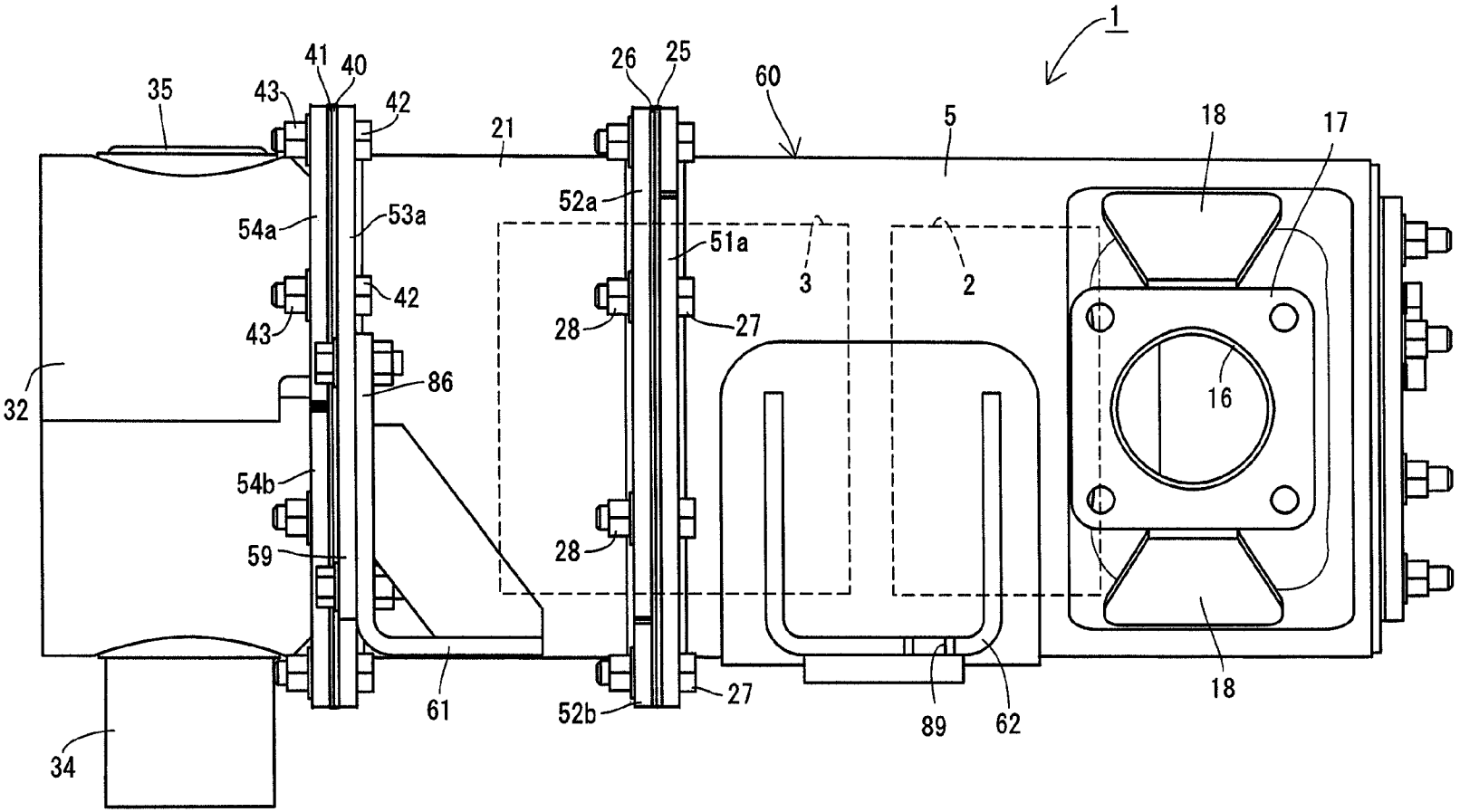
FIG. 5 is a front elevational view of the outer appearance of the DPF.
Figure 6:
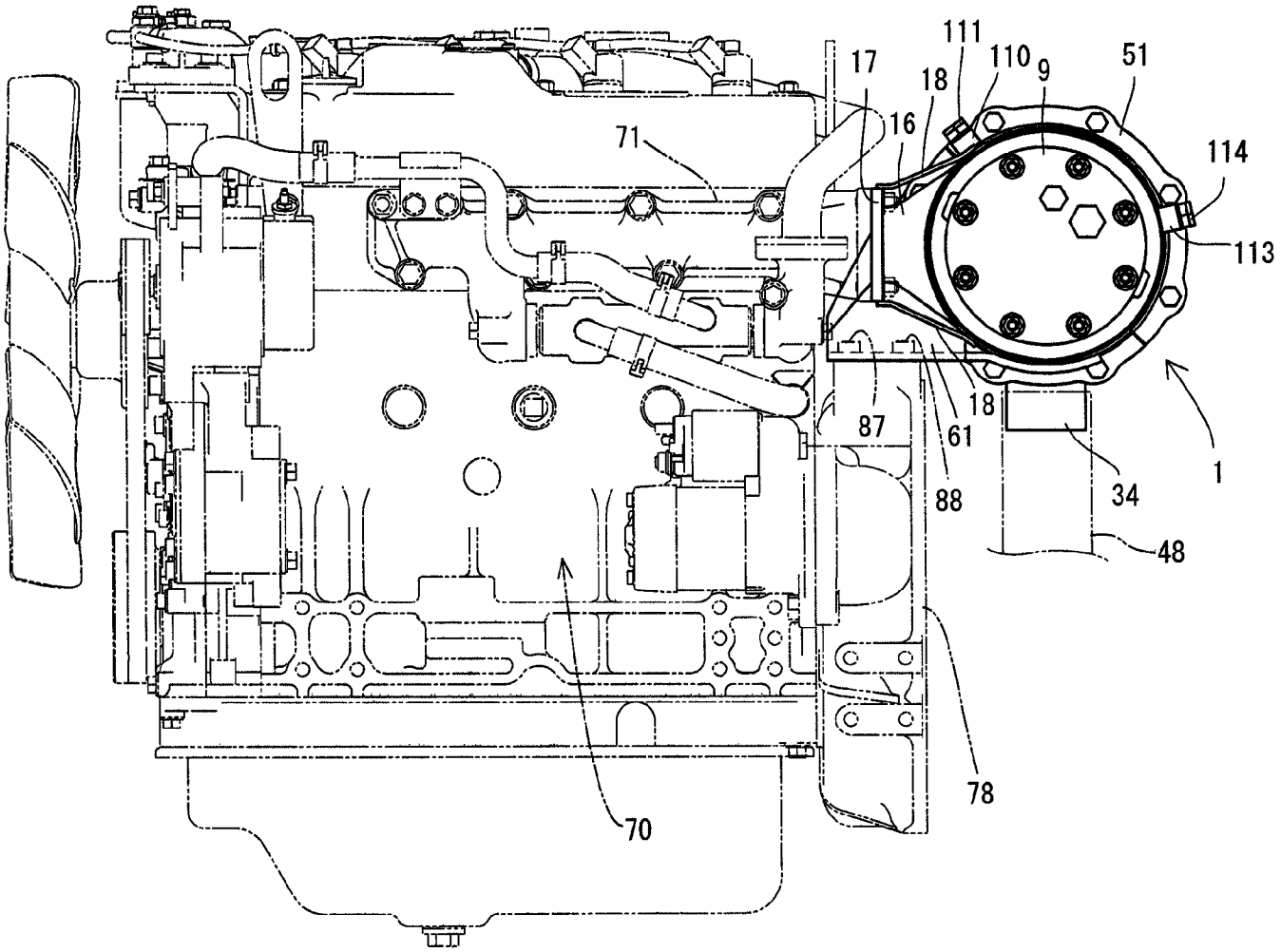
FIG. 6 is a side elevational view of the outer appearance of the DPF.
Figure 7:
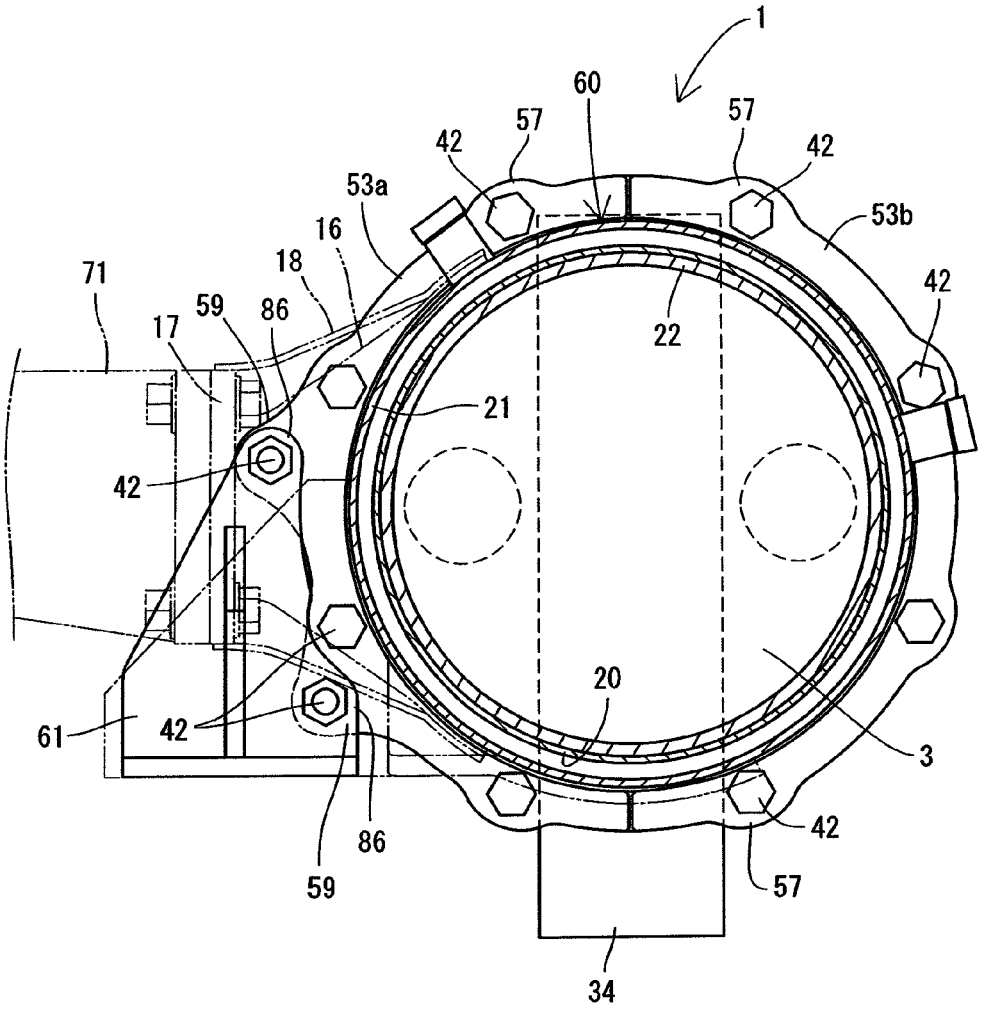
FIG. 7 is a side elevational view of a cross section in an upstream side of the DPF.
Figure 13:
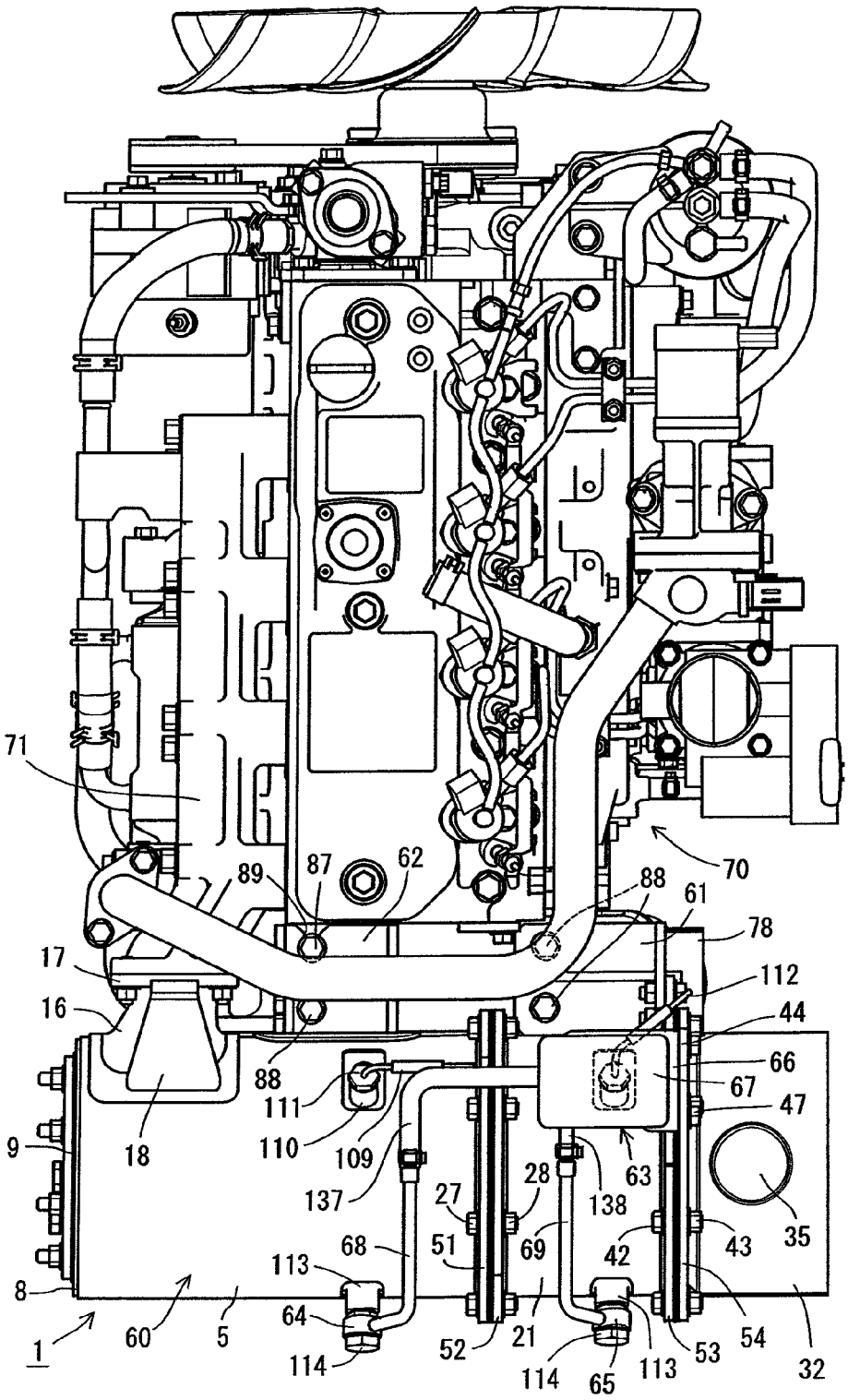
FIG. 13 is a plan view of a diesel engine which is provided with the DPF.
Figure 14:
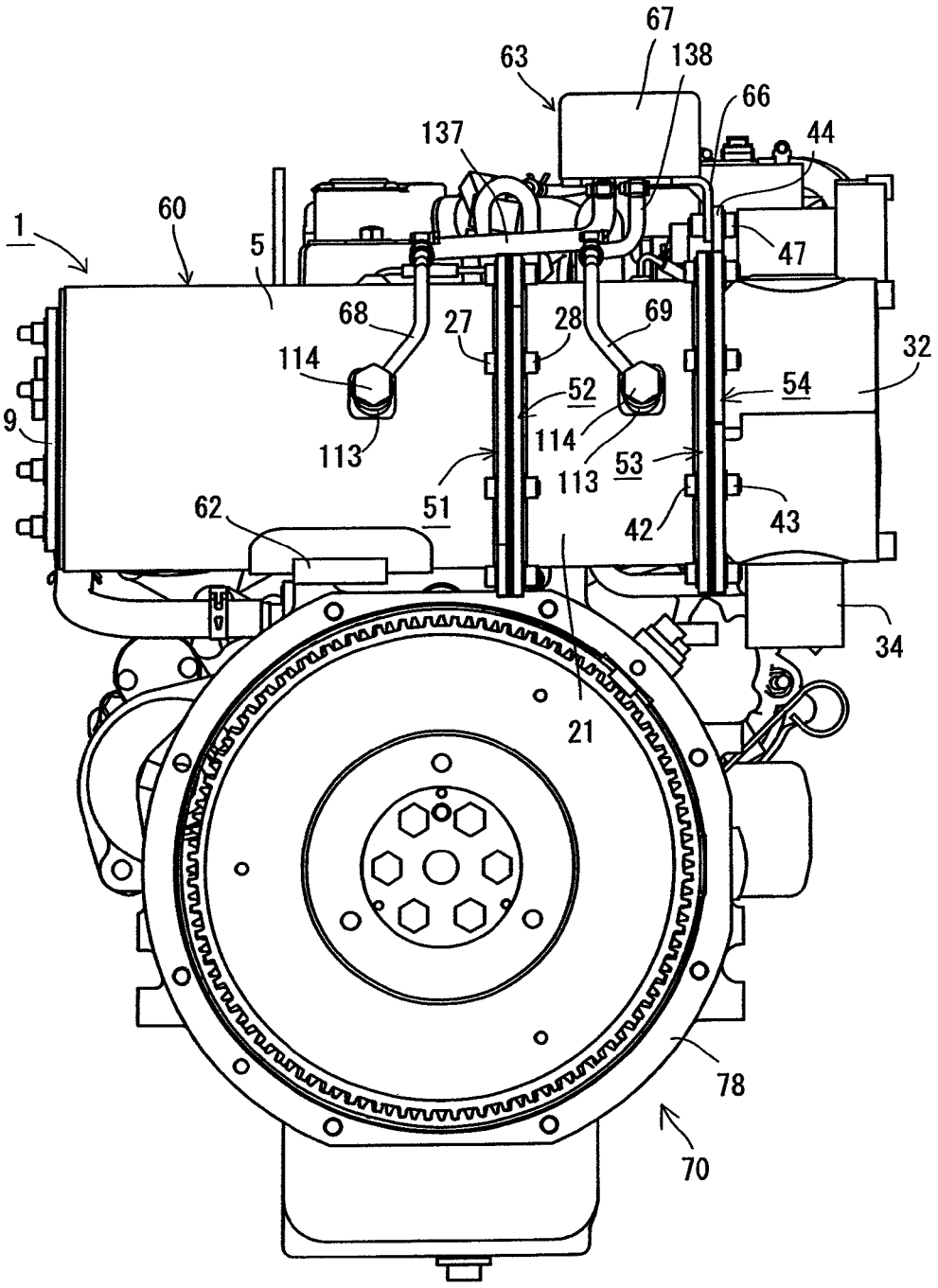
FIG. 14 is a back elevational view of the diesel engine which is provided with the DPF.

As shown in FIG. 1, FIG. 6 and FIG. 13, the DPF 1 serving as the exhaust gas purification device is provided for collecting the particulate matter (PM) in the exhaust gas. The DPF 1 is structured as an approximately cylindrical shape which extends long in a lateral direction which intersects an output shaft (a crank shaft) of the diesel engine 70 in a plan view. The DPF 1 is arranged on a flywheel housing 78 of the diesel engine 70. Both left and right sides (one end side and the other end side in a moving direction of the exhaust gas) of the DPF 1 are provided with an exhaust gas inlet pipe 16 (an exhaust gas intake side), and an exhaust gas outlet pipe 34 (an exhaust gas discharge side) so as to be sorted to left and right sides of the diesel engine 70. The exhaust gas inlet pipe 16 in the exhaust gas intake side of the DPF 1 is detachably fastened by bolt to an exhaust manifold 71 of the diesel engine 70. A tail pipe 107 is connected to the exhaust gas outlet pipe 34 in the exhaust gas discharge side of the DPF 1.

As shown in FIG. 1 to FIG. 6, the DPF 1 is structured such that a diesel oxidation catalyst 2, for example, a platinum or the like and a soot filter 3 of a honeycomb structure are accommodated in series side by side in a DPF casing 60 made of a heat resisting metal material, via cylindrical inside cases 4 and 20. The DPF 1 is attached to a flywheel housing 78 via a flange side bracket leg 61 and a casing side bracket leg 62 serving as a support body. In this case, one end side of the flange side bracket leg 61 is detachably fastened by bolt to an outer peripheral side of the DPF casing 60 via a flange 40 mentioned later. One end side of the casing side bracket leg 62 is integrally fixed by welding to an outer peripheral surface of the DPF casing 60.

On the other hand, as shown in FIGS. 1 to 6, FIG. 13 and FIG. 18 to FIG. 21, the other end side of the flange side bracket leg 61 is detachably fastened to a DPF attaching portion 80 in an upper surface of the flywheel housing 78 by two after attaching bolts 88. In other words, bolt through holes 88*a* are provided in the flange side bracket leg 61. Thread holes 88*b* are provided upward in the DPF attaching portion 80. It is structured such that the flange side bracket leg 61 is mounted to a flat upper surface of the DPF attaching portion 80, the after attaching bolts 88 are fastened to the thread holes 88*b* via the bolt through holes 88*a*, and the DPF 1 is detachably fixed to the upper surface of the flywheel housing 78 via the flange side bracket leg 61.

Further, the other end side of the casing side bracket leg 62 is detachably fastened to the upper surface (the DPF attaching portion) of the flywheel housing 78 by a before attaching bolt 87 and the after attaching bolt 88. In other words, bolt through holes 87*a* and 88*a* are provided in the casing side bracket leg 62. The thread hole 87*b* is provided upward in the DPF attaching portion 80. It is structured such that the flange side bracket leg 61 is mounted to a flat upper surface of the DPF attaching portion 80, the before attaching bolt 87 and the after attaching bolt 88 are fastened to the thread hole 87*b* via the bolt through holes 87*a* and 88*a*, and the DPF 1 is detachably fixed to the upper surface of the flywheel housing 78 via the casing side bracket leg 62.

Figure 19:
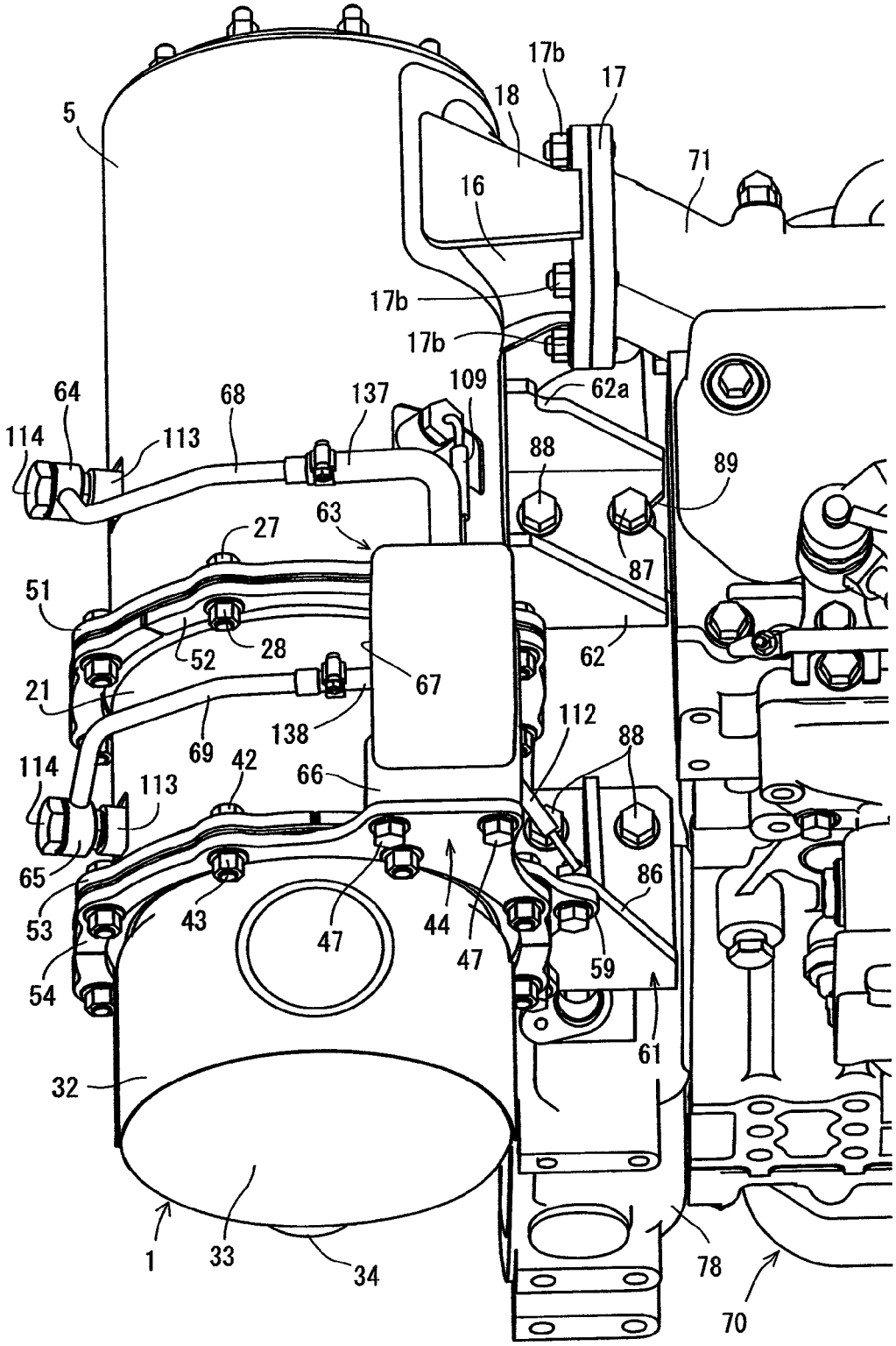
FIG. 19 is a partly enlarged view in FIG. 18.
Figure 20:
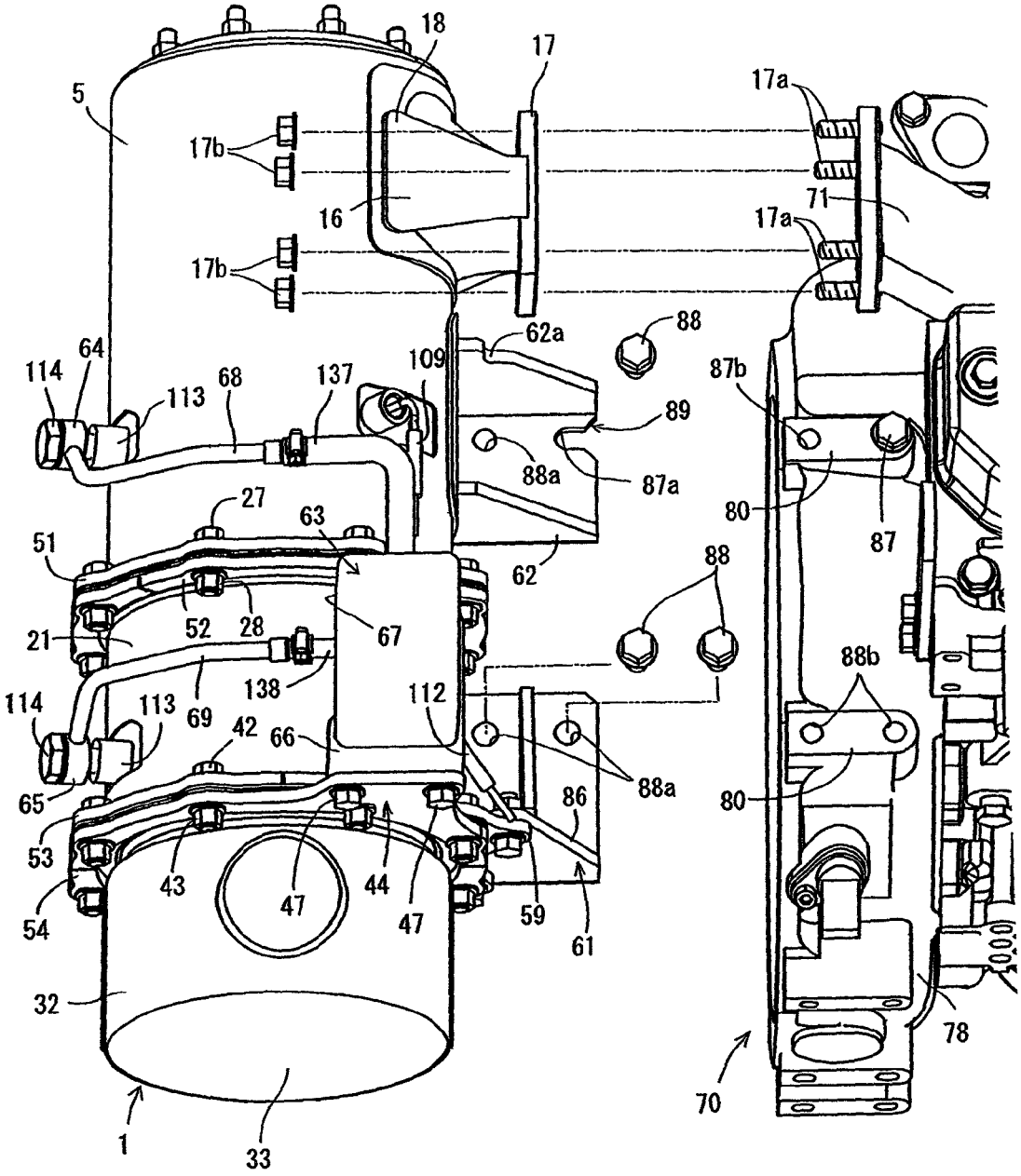
FIG. 20 is an assembled (disassembled) explanatory view of FIG. 19.
Figure 21:
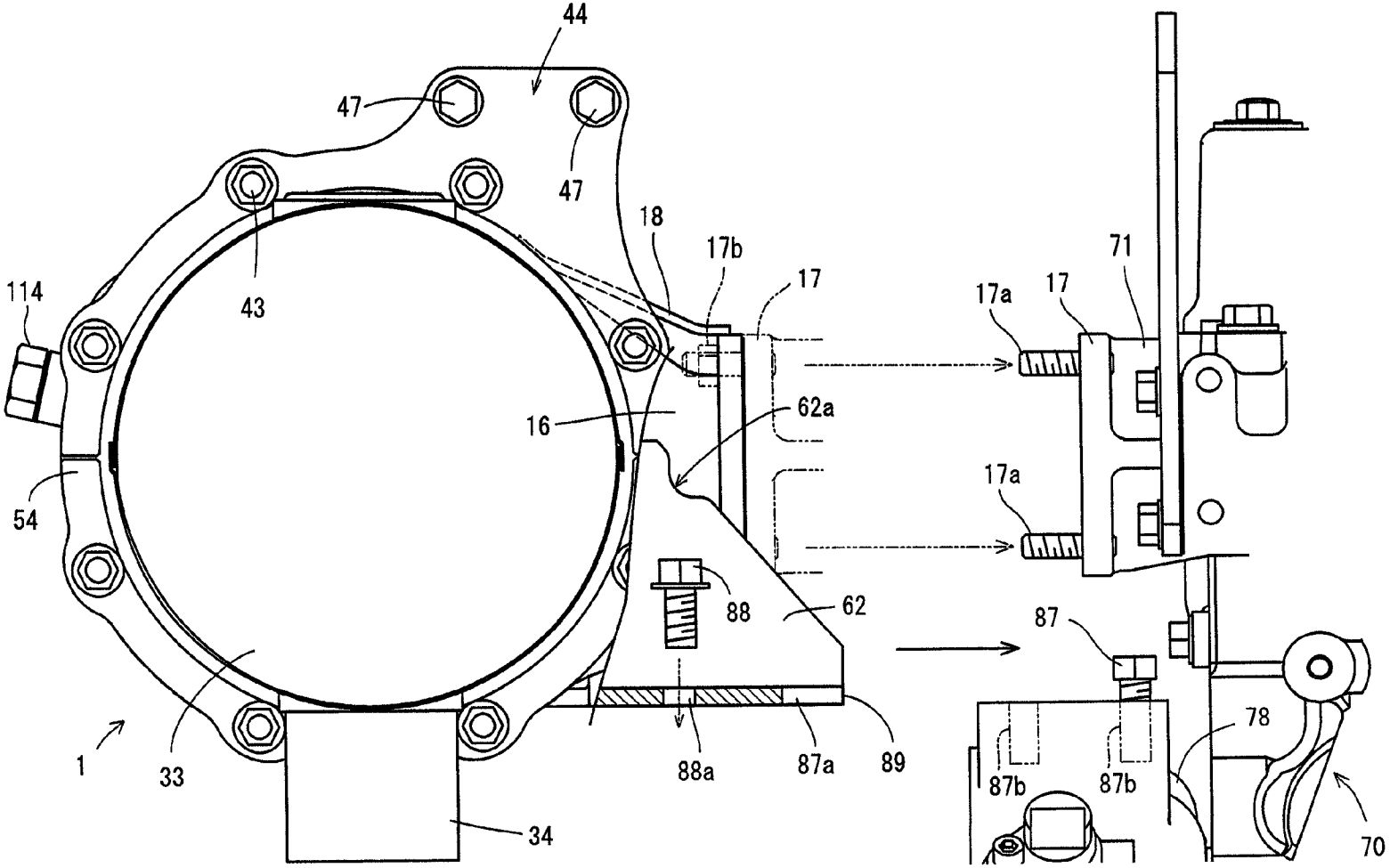
FIG. 21 is a cross sectional explanatory view of a substantial part in FIG. 20.

Further, as shown in FIG. 19 to FIG. 21, a notch groove 89 for making the before attaching bolt 87 lock into the bolt through hole 87*a* is formed in the other end side of the casing side bracket leg 62. A notch groove 89 is open to a front end edge of the casing side bracket leg 62 in such a manner that an opening portion of the notch groove 89 is positioned at a head at a time of assembling the DPF 1 in the diesel engine 70. In this case, an open edge portion of the notch groove 89 is formed as a taper shape which broadens toward the end (broadens toward the top).

In accordance with the structure mentioned above, as shown in FIG. 21, in the case that the DPF 1 is assembled in the diesel engine 70, first of all, the before attaching bolt 87 is incompletely screwed to the DPF attaching portion 80 in the upper surface of the flywheel housing 78 via the thread hole 87*b*. In a state in which a head portion of the before attaching bolt 87 is away from the upper surface of the DPF attaching portion 80 at an amount which is equal to or more than a thickness of the casing side bracket leg 62, the before attaching bolt 87 is supported to the DPF attaching portion 80. Further, the worker lifts up the DPF 1 by both hands, locks the thread hole 87*b* of the casing side bracket leg 62 to the head portion of the before attaching bolt 87 via the notch groove 89, and temporarily fixes the DPF 1 to the upper surface of the flywheel housing 78. In this state, the worker can release hands from the DPF 1.

Thereafter, the flange side bracket leg 61 and the casing side bracket leg 62 are fastened to the DPF attaching portion 80 in the upper surface of the flywheel housing 78 by three after attaching bolts 88. On the other hand, an inlet flange body 17 is fastened to the exhaust manifold 71 via a stud 17*a* and an inlet flange nut 17*b*, and the exhaust gas inlet pipe 16 is firmly fixed to the exhaust manifold 71. In this case, a tool clearance notch 62*a* is formed in an upper edge side of the casing side bracket leg 62, and the tool clearance notch 62*a* can prevent a wrench (a fastening tool) from coming into contact with the upper edge side of the casing side bracket leg 62 at a time of fastening the inlet flange nut 17*b*.

Next, the before attaching bolt 87 is completely fastened to the DPF attaching portion 80 in the upper surface of the flywheel housing 78, and the DPF 1 is firmly fixed detachably to the exhaust gas outlet side of the exhaust manifold 71 and the upper surface of the flywheel housing 78, thereby completing a work of assembling the DPF 1 in the diesel engine 70. In this case, in the front surface side in the attaching and detaching direction of the DPF casing 60, since the bolt through hole 87*a* for inserting the bolt is open to the front side edge of the casing side bracket leg 62 via the notch groove 89, it is possible to engage the bolt through hole 87*a* with the before attaching bolt 87 via the notch groove 89 by lifting up the DPF casing 60 by both hands in a state in which the before attaching bolt 87 is temporarily fixed and installed in an incomplete fastened (a pre-set) attitude, and moving to an attaching position of the diesel engine 70 (or the main machine), that is, the upper surface of the flywheel housing 78.

In other words, the worker can fasten the flange side bracket leg 61 and the casing side bracket leg 62 by fastening the after attaching bolt 88 (the bolt) in a state of releasing hands from the DPF casing 60. In this case, the DPF 1 can be detached in accordance with an inverse procedure to the above. As a result, the DPF 1 (the DPF casing 60) can be stably coupled and supported to a rear portion of the diesel engine 70, in an upper portion of the flywheel housing 78 which is a high rigidity member, by the respective bracket legs 61 and 62 and the exhaust manifold 71. Further, it is possible to execute an attaching and detaching work of the DPF 1 to and from the diesel engine 70 by only one worker.

In accordance with the structure mentioned above, the exhaust gas of the diesel engine 70 flows into the diesel oxidation catalyst 2 side within the DPF casing 60 from the exhaust manifold 71 of the diesel engine 70, and moves from the diesel oxidation catalyst 2 to the soot filter 3 side so as to be purified. The particulate matter in the exhaust gas can not pass through a porous shaped partition wall between cells in the soot filter 3. In other words, the particulate matter in the exhaust gas is collected in the soot filter 3. Thereafter, the exhaust gas having passed through the diesel oxidation catalyst 2 and the soot filter 3 is discharged to the tail pipe 107.

Since a temperature of the exhaust gas goes beyond a regenerable temperature (for example, about 300° C.) at a time when the exhaust gas passes through the diesel oxidation catalyst 2 and the soot filter 3, NO (nitrogen monoxide) in the exhaust gas is oxidized into an unstable $NO_2$ (nitrogen dioxide) on the basis of an action of the diesel oxidation catalyst 2. Further, the particulate matter which is picked up by the soot filter 3 is oxidized and removed by O (oxygen) which is discharged at a time when $NO_2$ is returned to NO. In the case that the particulate matter is piled up in the soot filter 3, the particulate matter is oxidized and removed by retaining the temperature of the exhaust gas equal to or higher than the regenerable temperature. Therefore, a particulate matter collecting capacity of the soot filter 3 is recovered (the soot filter 3 is regenerated).

A description will be given of a structure which assembles the diesel oxidation catalyst 2 corresponding to one example of an exhaust gas purifying body (a filter) which purifies the exhaust gas discharged by the diesel engine 70, with reference to FIG. 1 and FIG. 9. The diesel oxidation catalyst 2 is provided within an approximately cylindrical catalyst inside case 4 made of a heat resisting metal material. The catalyst inside case 4 is provided within an approximately cylindrical catalyst outside case 5 made of a heat resisting metal material. In other words, the catalyst inside case 4 is fitted to an outer side of the diesel oxidation catalyst 2 via a mat shaped catalyst heat insulating material 6 made of a ceramic fiber. The catalyst heat insulating material 6 is pressure inserted between the diesel oxidation catalyst 2 and the catalyst inside case 4, thereby protecting the diesel oxidation catalyst 2.

Further, the catalyst outside case 5 is fitted to an outer side of the catalyst inside case 4 via a support body 7 constructed by an end face L-shaped thin plate. The catalyst outside case 5 is one of elements which construct the DPF casing 60 mentioned above. In this case, the diesel oxidation catalyst 2 is protected by the catalyst heat insulating material 6. A stress (a mechanical vibration and a deforming force) of the catalyst outside case 5 which is transmitted to the catalyst inside case 4 is lowered by the support body 7 constructed by the thin plate.

Figure 9:
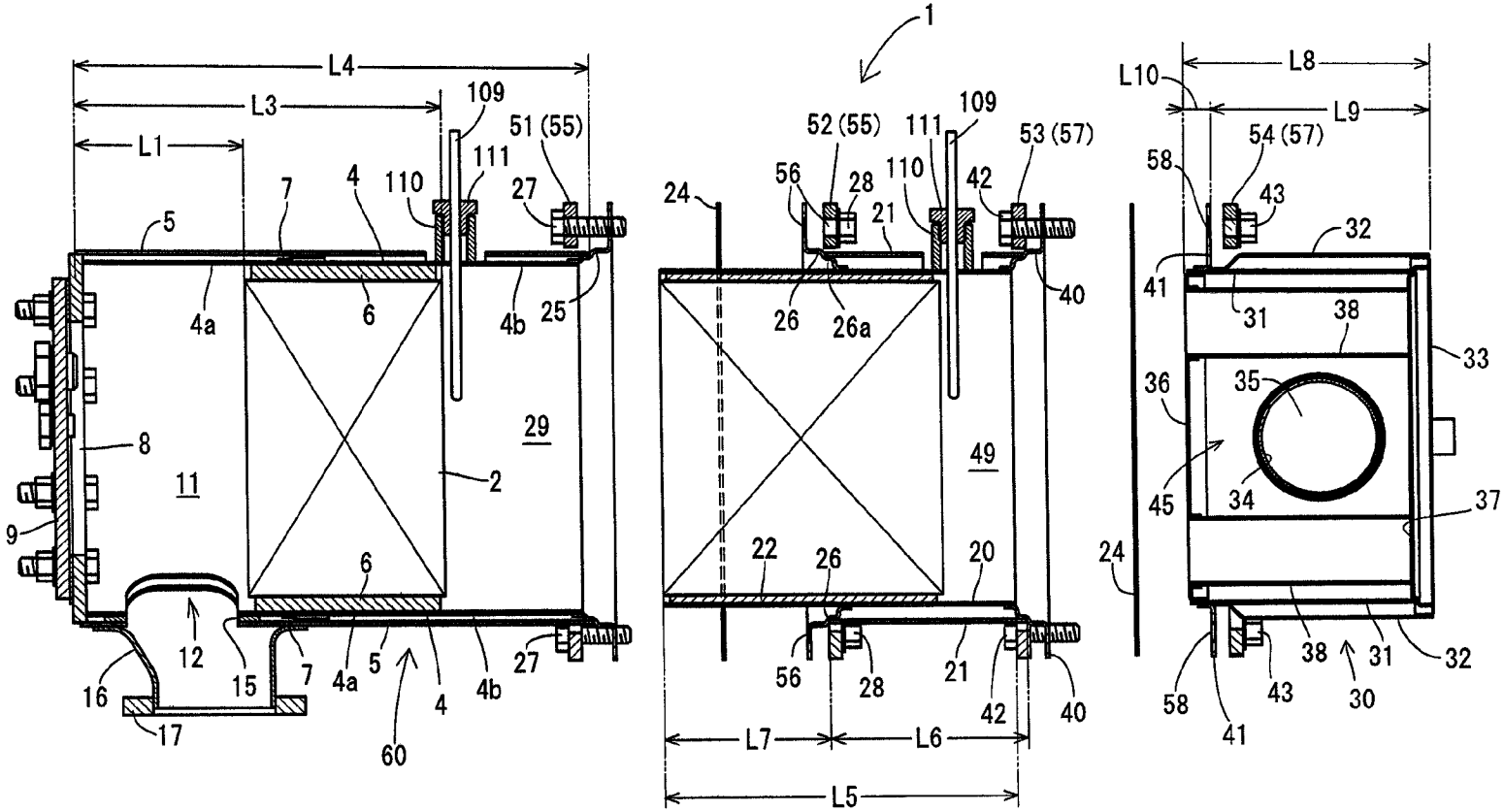
FIG. 9 is an explanatory view of an exploded cross section of the DPF.
Figure 10:
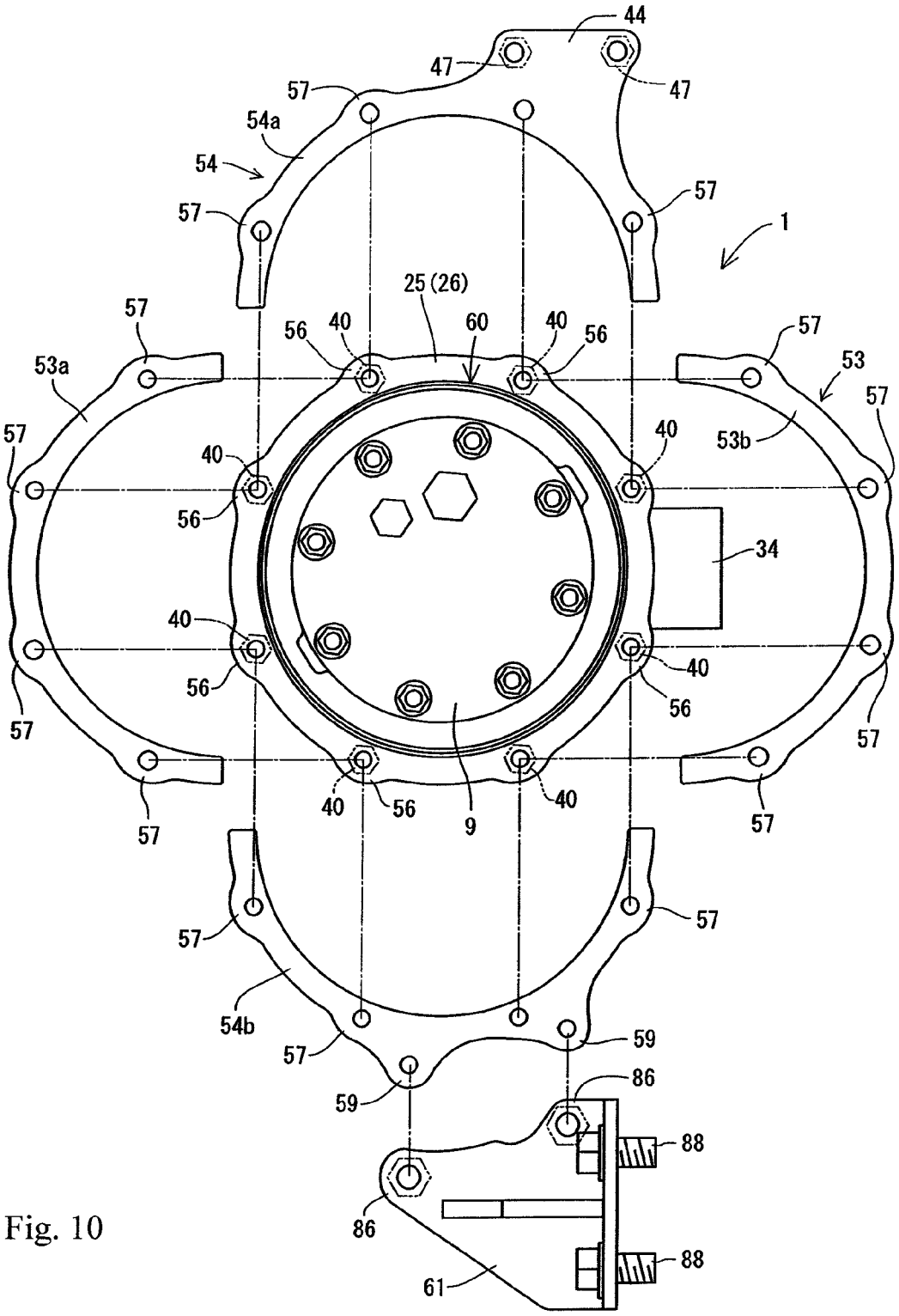
FIG. 10 is a separated side elevational view of a pinching flange (a semicircular arc body)

As shown in FIG. 1 and FIG. 9, a discoid side lid body 8 is firmly fixed to one side end portion of the catalyst inside case 4 and the catalyst outside case 5 by welding. An outer lid body 9 is fastened to an outer surface side of the side lid body 8 by a bolt and a nut. A gas inflow side end surface 2*a* of the diesel oxidation catalyst 2 and the side lid body 8 are spaced only at a fixed distance L1 (a gas inflow space 11). The exhaust gas inflow space 11 is formed between the gas inflow side end surface 2*a* of the diesel oxidation catalyst 2 and the left side lid body 8. An exhaust gas inflow port 12 which faces the exhaust gas inflow space 11 is opened to the catalyst inside case 4 and the catalyst outside case 5. An occlusion ring body 15 is firmly fixed in a pinching manner between an opening edge of the catalyst inside case 4 and an opening edge of the catalyst outside case 5. Since a gap between the opening edge of the catalyst inside case 4 and the opening edge of the catalyst outside case 5 is closed by the occlusion ring body 15, it is possible to prevent the exhaust gas from flowing into between the catalyst inside case 4 and the catalyst outside case 5.

As shown in FIGS. 1 to 6 and FIG. 9, an exhaust gas inlet pipe 16 is arranged in an outer surface of the catalyst outside case 5 in which the exhaust gas inflow port 12 is formed. The inlet flange body 17 is fixed by welding to one opening end portion of the exhaust gas inlet pipe 16. The inlet flange body 17 is detachably fastened by bolt to the exhaust manifold 71 of the diesel engine 70. One opening end portion of the exhaust gas inlet pipe 16 is communicated with the exhaust manifold 71. The other opening end portion of the exhaust gas inlet pipe 16 is welded to the outer surface of the catalyst outside case 5 in such a manner as to cover the exhaust gas inflow port 12 from an outer side. In this case, a pair of reinforcing bracket bodies 18 are fixed by welding between the outer surface of the catalyst outside case 5 and the side edge of the inlet flange body 17, and a coupling strength between the exhaust manifold 71 and the exhaust gas inlet pipe 16 is secured.

In accordance with the structure mentioned above, the exhaust gas of the diesel engine 70 enters into the exhaust gas inlet pipe 16 from the exhaust manifold 71, enters into the exhaust gas inflow space 11 from the exhaust gas inlet pipe 16 via the exhaust gas inflow port 12, and is supplied to the diesel oxidation catalyst 2 from the gas inflow side end surface 2*a* in a left side thereof. The nitrogen dioxide ($NO_2$) is created on the basis of the oxidizing action of the diesel oxidation catalyst 2.

A description will be given of a structure which assembles the soot filter 3 corresponding to one example of the exhaust gas purifying body (the filter) which purifies the exhaust gas discharged by the diesel engine 70 with reference to FIG. 1 and FIG. 9. The soot filter 3 is provided within a filter inside case 20 which is made of a heat resisting metal material and is formed as an approximately cylindrical shape. The filter inside case 20 is provided within a filter outside case 21 which is made of a heat resisting metal material and is formed as an approximately cylindrical shape. In other words, the filter inside case 20 is fitted to an outer side of the soot filter 3 via a mat shaped filter heat insulating material 22 made of a ceramic fiber. The filter outside case 21 is one of the elements which construct the DPF casing 60 mentioned above together with the catalyst outside case 5. In this case, the filter heat insulating material 22 is pressure inserted between the soot filter 3 and the filter inside case 20 so as to protect the soot filter 3.

As shown in FIG. 1 and FIG. 9, the catalyst inside case 4 which is formed as a cylindrical shape having a straight ridge line is constructed by an upstream side tube portion 4*a* which accommodates the diesel oxidation catalyst 2, and a downstream side tube portion 4*b* to which the filter inside case 20 mentioned below is inserted. In this case, the upstream side tube portion 4*a* and the downstream side tube portion 4*b* are cylinders having approximately the same diameter. Further, it is provided with a catalyst side junction flange 25 which is fixed by welding to an outer periphery of the catalyst inside case 4 and is formed as a thin plate ring shape, and a filter side junction flange 26 which is fixed by welding to an outer periphery of the filter inside case 20 and is formed as a thin plate ring shape. The catalyst side junction flange 25 and the filter side junction flange 26 are formed as a donut shape having an L-shaped cross sectional end face.

An inner peripheral side of the L-shaped cross sectional end face of the catalyst side junction flange 25 is fixed by welding to an end portion of the downstream side tube portion 4*b* of the catalyst inside case 4. An outer peripheral side of the L-shaped cross sectional end face of the catalyst side junction flange 25 is protruded toward an outer peripheral side (a radial direction) of the catalyst outside case 5. A step portion 25*a* is formed in a folded corner portion of the L-shaped cross sectional end face of the catalyst side junction flange 25. An end portion in a downstream side of the catalyst outside case 5 is fixed by welding to the step portion 25*a*.

On the other hand, an inner peripheral side of the L-shaped cross sectional end face of the filter side junction flange 26 is fixed by welding to a midway portion in an exhaust gas moving direction, in the outer periphery of the filter inside case 20. An outer peripheral side of the L-shaped cross sectional end face of the filter side junction flange 26 is protruded toward an outer peripheral side (a radial direction) of the filter outside case 21. A step portion 26*a* is formed in a folded corner portion of the L-shaped cross sectional end face of the filter side junction flange 26. An end portion in an upstream side of the filter outside case 21 is fixed by welding to the step portion 26*a*. In this case, the filter inside case 20 is formed as a cylindrical shape having a straight ridge line. The exhaust gas upstream side end portion and the downstream side end portion of the filter inside case 20 are cylinders having approximately the same diameter.

Further, an outer diameter of the diesel oxidation catalyst 2 is formed equal to an outer diameter of the soot filter 3. A thickness of the catalyst heat insulating material 6 is formed larger than a thickness of the filter heat insulating material 22. On the other hand, the catalyst inside case 4 and the filter inside case 20 are formed by a material having the same thickness. An outer diameter of the filter inside case 20 is formed smaller in comparison with an inner diameter of the downstream side tube portion 4*b* of the catalyst inside case 4. A downstream side gap 23 is formed between an inner peripheral surface of the catalyst inside case 4 and an outer peripheral surface of the filter inside case 20. The downstream side gap 23 is formed at a dimension (for example, 2 millimeter) which is larger than the thickness (for example, 1.5 millimeter) of each of the cases 4 and 20. For example, even if each of the cases 4 and 20 rusts or thermally deforms, it is possible to easily move the exhaust gas upstream side end portion of the filter inside case 20 into and out of the downstream side tube portion 4*b* of the catalyst inside case 4.

As shown in FIG. 1 to FIG. 5, FIG. 9 and FIG. 12, the catalyst side junction flange 25 and the filter side junction flange 26 are confronted via the gasket 24. Each of the junction flanges 25 and 26 is pinched from both sides in the exhaust gas moving direction, by a pair of thick center pinching flanges 51 and 52 which surround the outer peripheral sides of the respective outside cases 5 and 21. The catalyst outside case 5 and the filter outside case 21 are detachably coupled by fastening the respective center pinching flanges 51 and 52 and pinching the respective junction flanges 25 and 26, by means of a bolt 27 and a nut 28.

Figure 12:
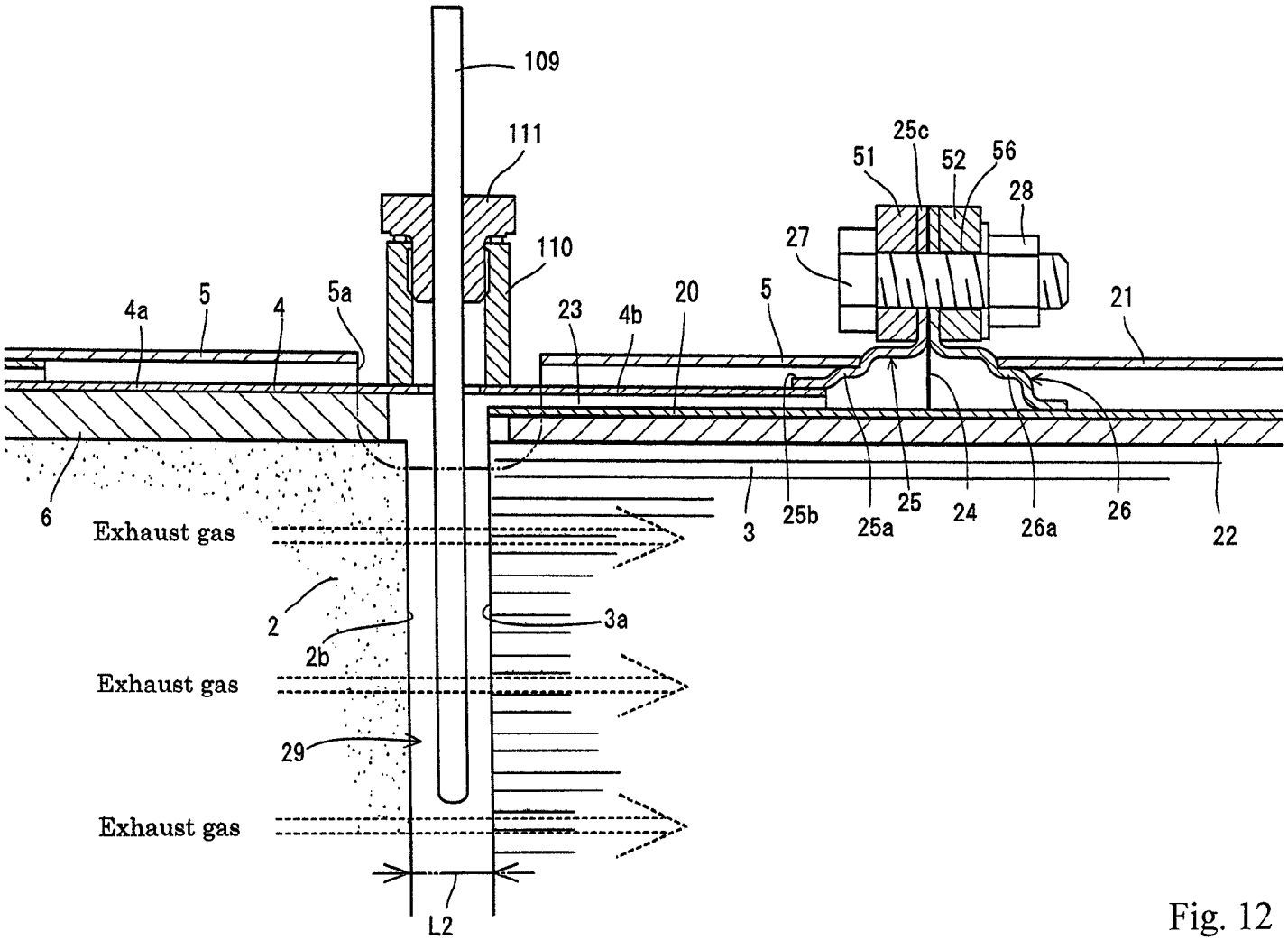
FIG. 12 is an enlarged cross sectional view showing an attaching portion of a sensor boss body for a temperature sensor.

As shown in FIG. 1 and FIG. 12, in a state in which the upstream side end portion of the filter outside case 21 is coupled to the downstream side end portion of the catalyst outside case 5 via the respective center pinching flanges 51 and 52 and the respective junction flanges 25 and 26, a catalyst downstream side space 29 is formed between the diesel oxidation catalyst 2 and the soot filter 3. In other words, the downstream side end portion of the diesel oxidation catalyst 2 and the upstream side end portion of the soot filter 3 (the filter inside case 20) are faced so as to be spaced at a sensor attaching distance L2.

As shown in FIG. 1 and FIG. 9, a cylinder length L4 in the exhaust gas moving direction of the catalyst outside case 5 is formed longer than a cylinder length L3 in the exhaust gas moving direction of the upstream side tube portion 4*a* in the catalyst inside case 4. A cylinder length L6 in the exhaust gas moving direction of the filter outside case 21 is formed shorter than a cylinder length L5 in the exhaust gas moving direction of the filter inside case 20. A length (L2+L3+L5) obtained by adding the sensor attaching distance L2 of the catalyst downstream side space 29, the cylinder length L3 of the upstream side tube portion 4*a* of the catalyst inside case 4, and the cylinder length L5 of the filter inside case 20 is structured such as to be approximately equal to a length (L4+L6) obtained by adding the cylinder length L4 of the catalyst outside case 5 and the cylinder length L6 of the filter outside case 21.

Further, the end portion in the upstream side of the filter inside case 20 protrudes from the end portion in the upstream side of the filter outside case 21 at a difference (L7≈L5−L6) between the lengths of the respective cases 20 and 21. Accordingly, in a state in which the filter outside case 21 is coupled to the catalyst outside case 5, the end portion in the upstream side of the filter inside case 20 is inserted to the downstream side of the catalyst outside case 5 (the downstream side tube portion 4*b* of the catalyst inside case 4), at the upstream side dimension L7 of the filter inside case 20 protruding out of the filter outside case 21. In other words, the upstream side of the filter inside case 20 is inserted into the downstream side tube portion 4*b* (the catalyst downstream side space 29) so as to be freely extracted.

In accordance with the structure mentioned above, the nitrogen dioxide ($NO_2$) which is created by the oxidizing action of the diesel oxidation catalyst 2 is supplied into the soot filter 3 from one side end face (an intake side end face) 3*a*. The particulate matter (PM) which is included in the exhaust gas of the diesel engine 70 is collected by the soot filter 3 and is continuously oxidized and removed by the nitrogen dioxide ($NO_2$). In addition to the removal of the particulate matter (PM) in the exhaust gas of the diesel engine 70, contents of the carbon oxide (CO) and the hydro carbon (HC) in the exhaust gas of the diesel engine 70 are reduced.

Figure 8:
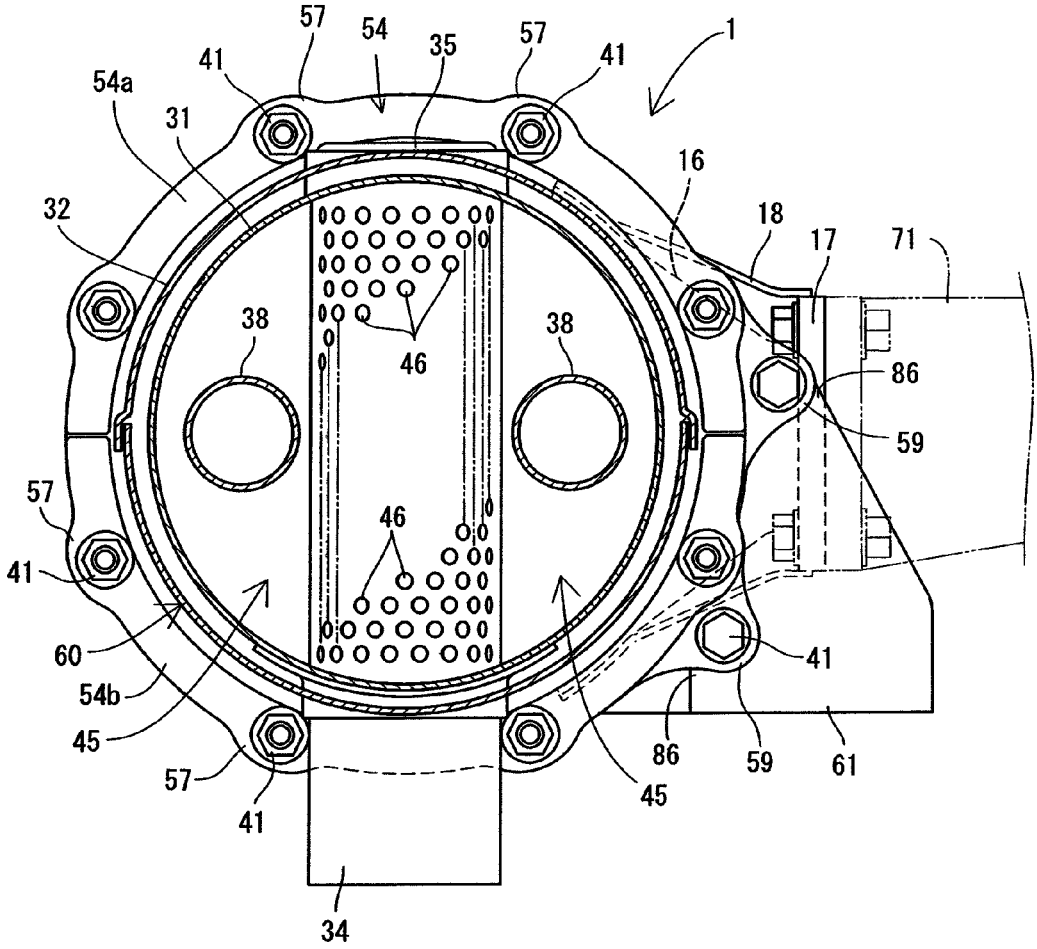
FIG. 8 is a side elevational view of a cross section in a downstream side of the DPF.

As shown in FIG. 1, FIG. 8 and FIG. 9, a silencer 30 which attenuates an exhaust gas sound discharged by the diesel engine 70 has a sound absorbing inside case 31 which is made of a heat resisting metal material and is formed as an appropriately cylindrical shape, a sound absorbing outside case 32 which is made of a heat resisting metal material and is formed as an approximately cylindrical shape, and a discoid side lid body 33 which is firmly fixed by welding to a side end portion in a downstream side of the sound absorbing outside case 32. The sound absorbing inside case 31 is provided within the sound absorbing outside case 32. The sound absorbing outside case 32 constructs the DPF casing 60 mentioned above together with the catalyst outside case 5 and the filter outside case 21. In this case, a diameter of the cylindrical sound absorbing outside case 32 is approximately the same dimension as the diameter of the cylindrical catalyst outside case 5 and the diameter of the cylindrical filter outside case 21.

Discoid inner lid bodies 36 and 37 are firmly fixed by welding to both side end portions in an exhaust gas moving direction of the sound absorbing inside case 31. A pair of exhaust gas introduction pipes 38 are provided between the respective inner lid bodies 36 and 37. An upstream side end portion of each of the exhaust gas introduction pipes 38 passes through the upstream inner lid body 36. A downstream side end portion of each of the exhaust gas introduction pipes 38 is clogged by the downstream inner lid body 37. A plurality of communication holes 39 are formed in an intermediate portion of each of the exhaust gas introduction pipes 38. An expansion chamber 45 is communicated within each of the exhaust gas introduction pipes 38 via the communication holes 39. The expansion chamber 45 is formed in an inner portion of the sound absorbing inside case 31 (between the respective inner lid bodies 36 and 37).

The exhaust gas outlet pipe 34 arranged between the respective exhaust gas introduction pipes 38 is passed through the sound absorbing inside case 31 and the sound absorbing outside case 32. One end side of the exhaust gas outlet pipe 34 is clogged by the outlet lid body 35. A lot of exhaust holes 46 are provided in a whole of the exhaust gas outlet pipe 34 in an inner portion of the sound absorbing inside case 31. Each of the exhaust gas introduction pipes 38 is communicated with the exhaust gas outlet pipe 34 via the plurality of communication holes 39, the expansion chamber 45 and a lot of the exhaust holes 46. A tail pipe 48 is connected to the other end side of the exhaust gas outlet pipe 34. In accordance with the structure mentioned above, the exhaust gas entering into both the exhaust gas introduction pipes 38 of the sound absorbing inside case 31 passes through the exhaust gas outlet pipe 34 via the plurality of communication holes 39, the expansion chamber 45 and a lot of the exhaust holes 46, and is discharged out of the silencer 30 via the tail pipe 48.

As shown in FIG. 1 and FIG. 9, an inner diameter side of a filter outlet side junction flange 40 formed as a thin plate ring shape is fixed by welding to an end portion in a downstream side of the filter inside case 20. An outer diameter side of the filter outlet side junction flange 40 is protruded toward an outer peripheral side (a radially outside or a radial direction) of the filter outside case 21. An end portion in a downstream side of the filter outside case 21 is fixed by welding to an outer peripheral side (an end face L-shaped corner portion) of the filter outlet side junction flange 40. A sound absorbing side junction flange 41 which protrudes to an outer peripheral side (a radially outer side) of the sound absorbing outside case 32 and is formed as a thin plate shape is fixed by welding to an end portion in an upstream side of the sound absorbing inside case 31. In this case, an upstream side of the sound absorbing inside case 31 is protruded at a predetermined cylinder dimension L10 to an exhaust gas upstream side of the sound absorbing side junction flange 41. An end portion in an upstream side of the sound absorbing outside case 32 is fixed by welding to an outer peripheral surface of the sound absorbing inside case 31 in a downstream side of the sound absorbing side junction flange 41.

As shown in FIG. 1 and FIG. 7 to FIG. 10, the filter outlet side junction flange 40 and the sound absorbing side junction flange 41 are confronted via the gasket 24, and each of the junction flanges 40 and 41 is pinched from both sides on the exhaust gas moving direction by a pair of outlet pinching flanges 53 and 54 which surround an outer peripheral side of each of the outside cases 21 and 32 and are formed as a thick plate shape. The filter outside case 21 and the sound absorbing outside case 32 are detachably coupled by respectively fastening the outlet pinching flanges 53 and 54 to the junction flanges 40 and 41 by a bolt 42 and a nut 43.

As shown in FIG. 1 and FIG. 9, a cylinder length L9 in the exhaust gas moving direction of the sound absorbing outside case 32 is formed shorter than a cylinder length L8 in the exhaust gas moving direction of the sound absorbing inside case 31. An end portion in an upstream side of the sound absorbing inside case 31 is protruded at a difference (L10≈L8−L9) of the lengths of the cases 31 and 32 from an end portion (the junction flange 41) in the upstream side of the sound absorbing outside case 32. In other words, in a state in which the sound absorbing outside case 32 is coupled to the filter outside case 21, the upstream side end portion of the sound absorbing inside case 31 is inserted to a filter downstream side space 49 which is formed within a downstream side end portion (the filter outlet side junction flange 40) of the filter outside case 21, at the dimension L10 at which the end portion in the upstream side of the sound absorbing inside case 31 protrudes.

As shown in FIG. 1 and FIG. 7 to FIG. 10, the center pinching flange 51 (52) formed as a thick plate shape is constructed by a plurality of (two in the embodiment) semicircular arc bodies 51*a* and 51*b* (52*a* and 52*b*) which are divided in a peripheral direction of the catalyst outside case 5 (the filter outside case 21). Each of the semicircular arc bodies 51*a* and 51*b* (52*a* and 52*b*) in accordance with the embodiment is formed as a circular arc shape (an approximately semicircular horseshoe shape). In a state in which the filter outside case 21 is coupled to the catalyst outside case 5, each of end portions of each of the semicircular arc bodies 51*a* and 51*b* (52*a* and 52*b*) comes into contact. In other words, it is structured such that an outer peripheral side of the catalyst outside case 5 (the filter outside case 21) is annularly surrounded by each of the semicircular arc bodies 51*a* and 51*b* (52*a* and 52*b*).

A plurality of bolt fastening portions 55 with through holes are provided in the center pinching flange 51 (52) at uniform intervals along the peripheral direction. In the embodiment, eight bolt fastening portions 55 are provided per one set of center pinching flanges 51. In the light of unit of each of the semicircular arc bodies 51*a* and 51*b* (52*a* and 52*b*), four bolt fastening portions 55 are provided at uniform intervals along the circumferential direction. On the other hand, a bolt hole 56 corresponding to each of the bolt fastening portions 55 of the center pinching flange 51 (52) is formed in a penetrating manner in the catalyst side junction flange 25 and the filter side junction flange 26.

At a time of coupling the catalyst outside case 5 and the filter outside case 21, an outer peripheral side of the catalyst outside case 5 is surrounded by both the semicircular arc bodies 51*a* and 51*b* on the catalyst side, an outer peripheral side of the filter outside case 21 is surrounded by both the semicircular arc bodies 52*a* and 52*b* on the filter side, and the catalyst side junction flange 25 and the filter side junction flange 26 which pinch the gasket 24 are pinched from both sides in the exhaust gas moving direction by these semicircular arc body groups (the center pinching flanges 51 and 52).

In the state mentioned above, a bolt 27 is inserted to the bolt fastening portion 55 of the center pinching flanges 51 and 52 on both sides, and the bolt hole 56 of both the junction flanges 25 and 26 so as to be fastened by a nut 28. As a result, both the junction flanges 25 and 26 are pinched and fixed by both the center pinching flanges 51 and 52, and a coupling between the catalyst outside case 5 and the filter outside case 21 is completed. In this case, the confronting portions between the end portions of the semicircular arc bodies 51*a* and 51*b* on the catalyst side are positioned to have their phase shifted at 72 degrees from the confronting portions between the end portions of the semicircular arc bodies 52*a* and 52*b* on the filter side.

As shown in FIG. 1 and FIG. 7 to FIG. 10, the outlet pinching flange 53 (54) formed as a thick plate shape is constructed by a plurality of (two in the embodiment) semicircular arc bodies 53*a* and 53*b* (54*a* and 54*b*) which are divided in the peripheral direction of the filter outside case 21 (the sound absorbing outside case 32). Each of the semicircular arc bodies 53*a* and 53*b* (54*a* and 54*b*) in accordance with the embodiment basically has the same aspect as the semicircular arc bodies 51*a* and 51*b* (52*a* and 52*b*) of the center pinching flange 51 (52). A plurality of bolt fastening portions 57 with through holes are provided also in the outlet pinching flange 53 (54) at uniform intervals along the peripheral direction. On the other hand, a bolt hole 58 corresponding to each of the bolt fastening portions 57 of the outlet pinching flange 53 (54) is formed in a penetrating manner in the filter outlet side junction flange 40 and the sound absorbing side junction flange 41.

At a time of coupling the filter outside case 21 and the sound absorbing outside case 32, the outer peripheral side of the filter outside case 21 is surrounded by both the semicircular arc bodies 53*a* and 53*b* on the filter outlet side, the outer peripheral side of the sound absorbing outside case 32 is surrounded by both the semicircular arc bodies 54*a* and 54*b* on the sound absorbing side, and the filter outlet side junction flange 40 and the sound absorbing side junction flange 41 which pinch the gasket 24 are pinched from both sides in the exhaust gas moving direction by these semicircular arc body groups (the outlet pinching flanges 53 and 54).

In the state mentioned above, a bolt 42 is inserted to the bolt fastening portion 57 of the outlet pinching flanges 53 and 54 on both sides, and the bolt hole 58 of both the junction flanges 40 and 41 so as to be fastened by a nut 43. As a result, both the junction flanges 40 and 41 are pinched and fixed by both the outlet pinching flanges 53 and 54, and a coupling between the filter outside case 21 and the sound absorbing outside case 32 is completed. In this case, the confronting portions between the end portions of the semicircular arc bodies 53*a* and 53*b* on the filter outlet side are positioned to have their phase shifted at 72 degrees from the confronting portions between the end portions of the semicircular arc bodies 54*a* and 54*b* on the sound absorbing side.

As shown in FIG. 1 and FIG. 7 to FIG. 10, the left bracket leg 61 which serves as a support body supporting the DPF casing 60 (the outside cases 5, 21 and 32) to the diesel engine 70 is attached at least to one of the pinching flanges 51 to 54. In the embodiment, a support body fastening portion 59 with a through hole is integrally formed in one semicircular arc body 53*a* in the outlet pinching flange 53 in the filter outlets side, at two positions in such a manner as to be positioned between the adjacent bolt fastening portions 57. On the other hand, an attaching boss portion 86 corresponding to the support body fastening portion 59 mentioned above is integrally formed in the left bracket leg 61.

In accordance with the structure mentioned above, the left bracket leg 61 is detachably fixed to the outlet pinching flange 53 on the filter outlet side, by fastening by bolt the attaching boss portion 86 of the left bracket leg 61 to the support body fastening portion 59 of one semicircular arc body 53*a* existing in the filter outlet side. One end side of the right bracket leg 62 is fixed by welding to the outer peripheral side of the DPF casing 60 (the catalyst outside case 5), and the other end sides of both the left and right bracket legs 61 and 62 are fastened by bolt to the DPF attaching portion 80 formed on an upper surface of the flywheel housing 78, in the same manner as mentioned above. As a result, the DPF 1 is stably coupled and supported to the upper portion of the flywheel housing 78 which is a high rigidity member, by both the left and right bracket legs 61 and 62 and an exhaust gas discharge pipe 103 of a turbine case 101.

As shown in FIG. 1 and FIG. 7 to FIG. 10, it has a gas purifying body (the diesel oxidation catalyst 2 and the soot filter 3) which purifies the exhaust gas discharged by the engine 70, the respective inside cases 4, 20 and 31 which have the diesel oxidation catalyst 2 and the soot filter 3 built-in, and the respective outside cases 5, 21 and 32 which have the respective inside cases 4, 20 and 31 built-in. Further, each of the inside cases 4, 20 and 31 is coupled to each of the outside cases 5, 21 and 32 via the junction flanges 25, 26, 40 and 41 which protrude to the outer peripheral side of each of the outside cases 5, 21 and 32. A plurality of outside cases 5, 21 and 32 are coupled by preparing plural sets of combinations of the gas purifying body (the diesel oxidation catalyst 2 and the soot filter 3), each of the inside cases 4, 20 and 31 and each of the outside cases 5, 21 and 32, and pinching and fixing each of the junction flanges 25 and 26 (40 and 41) by a pair of pinching flanges 51 and 52 (53 and 54).

Accordingly, it is possible to pinch the adjacent junction flanges 25 and 26 (40 and 41) from both sides by the pinching flanges 51 and 52 (53 and 54) so as to bring into pressure contact (close attach). Further, since the pinching flanges 51 to 54 are structured as the separate bodies without being welded to the outside cases 5, 21 and 32, there is no risk of a stress concentration and a strain caused by the welding, in the relation between the pinching flanges 51 to 54 and the outside cases 5, 21 and 32. Accordingly, it is possible to apply an approximately uniform pressure contact force to a whole of each of the flanges 25 and 26 (40 and 41), and it is possible to maintain a surface pressure of a seal surface (the pinching surface) of the pinching flanges 51 to 54 in a high state. As a result, it is possible to securely prevent an exhaust gas leakage from between the junction flanges 25 and 26 (40 and 41).

As shown in FIG. 1 and FIG. 7 to FIG. 10, each of the pinching flanges 51 to 54 is constructed by the plurality of horseshoe shaped semicircular arc bodies 51*a* and 51*b* (52*a*, 52*b*, 53*a*, 53*b*, 54*a* and 54*b*) which are divided in the peripheral direction of the outside cases 5, 21 and 32, and is structured such as to surround the outer peripheral side of the outside cases 5, 21 and 32 by the plurality of semicircular arc bodies 51*a* and 51*b* (52*a*, 52*b*, 53*a*, 53*b*, 54*a* and 54*b*). Accordingly, although they are the pinching flanges 51 to 54 constructed by a plurality of semicircular arc bodies 51*a* and 51*b* (52*a*, 52*b*, 53*a*, 53*b*, 54*a* and 54*b*), they come to the same assembled state as the integral structure. In accordance with this, it is easily to assemble the pinching flanges 51 to 54 in comparison with the ring shaped structure, and it is possible to improve an assembling workability. Further, it is possible to construct the DPF 1 having a high sealing property, while suppressing a process cost and an assembly cost.

Figure 11:
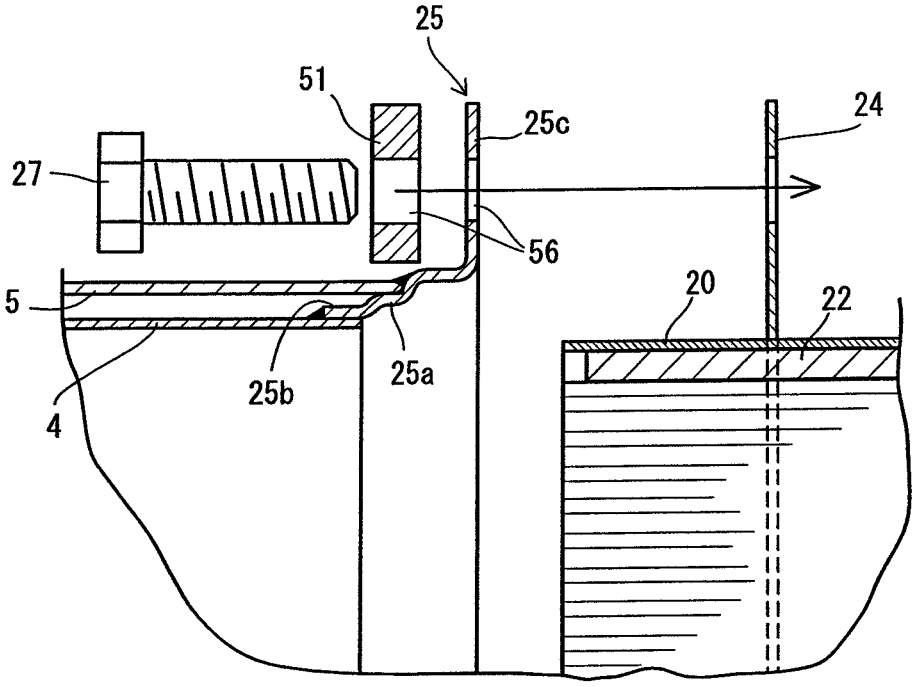
FIG. 11 is a cross sectional view of an enlarged side elevation of a catalyst side junction flange.

Next, a description will be given of a detailed structure of each of the junction flanges 25, 26 and 40 with reference to FIG. 11. Since the junction flanges 25, 26 and 40 basically have all the same structure, a description will be given of the catalyst side junction flange 25 which is fixed by welding to the catalyst inside case 4 and the catalyst outside case 5 as a representative example. FIG. 11 shows an enlarged side elevational cross sectional view of the catalyst side junction flange 25 in the embodiment. As shown in FIG. 11, the catalyst side junction flange 25 has the step portion 25*a* in which a cross sectional end face is folded as a step shape in an intermediate of an L-shaped form. A downstream side end portion of the catalyst outside case 5 is fitted to the step portion 25*a*, and the step portion 25*a* is fixed by welding to the downstream side end portion of the catalyst outside case 5.

On the other hand, an L-shaped inner diameter side end portion 25*b* of the catalyst side junction flange 25 is extended in an extending direction (the exhaust gas moving direction) of the catalyst inside case 4 (the catalyst outside case 5). The inner diameter side end portion 25*b* is fitted to the downstream side end portion of the catalyst inside case 4, and the inner diameter side end portion 25*b* is fixed by welding to the catalyst inside case 4. On the other hand, an L-shaped outer diameter side end portion 25*c* of the catalyst side junction flange 25 is extended toward a radial direction (a vertical direction) from an outer periphery of the catalyst outside case 5. A high rigidity of the catalyst side junction flange 25 is secured by forming the L-shaped form in the cross sectional end face of the catalyst side junction flange 25 and the step portion 25*a*.

In this case, the bolt 27 is passed through the pinching flanges 51 and 52 and the junction flanges 25 and 26 via the bolt holes 56, and is screw attached by the nut 28, and the pinching flanges 51 and 52 and the junction flanges 25 and 26 are fastened, whereby the outer diameter side end portion 25*c* of the catalyst side junction flange 25 is pinched by the pinching flanges 51 and 52, in the same manner as mentioned above.

Next, a description will be given of an upstream side gas temperature sensor 109 (a downstream side gas temperature sensor 112) which is provided in the DPF 1, as shown in FIG. 1 and FIG. 12. One end side of a cylindrical sensor boss body 110 is fixed by welding to the outer peripheral surface of the catalyst inside case 4, between the upstream side tube portion 4*a* and the downstream side tube portion 4*b* of the catalyst inside case 4. The other end side of the sensor boss body 110 is extended in a radial direction from the sensor attaching opening 5*a* of the catalyst outside case 5 toward the outer side of the case 5. A sensor attaching bolt 111 is attached by screw to the other end side of the sensor boss body 110. For example, the thermistor type upstream side gas temperature sensor 109 is passed through the sensor attaching bolt 111, and the upstream side gas temperature sensor 109 is supported to the sensor boss body 110 via the sensor attaching bolt 111. A detecting portion of the upstream side gas temperature sensor 109 is protruded into the catalyst downstream side space 29.

In accordance with the structure mentioned above, when the exhaust gas is discharged from the gas outflow side end face 2*b* of the diesel oxidation catalyst 2, the exhaust gas temperature is detected by the upstream side gas temperature sensor 109. In this case, in the same manner as mentioned above, as shown in FIG. 1, for example, the thermistor type downstream side gas temperature sensor 112 is attached to the sensor boss body 110 via the sensor attaching bolt 111, and the temperature of the exhaust gas in the other side end face (the discharge side end face) 3*b* of the soot filter 3 is detected by the downstream side gas temperature sensor 112.

Next, a description will be given of an attaching structure of a differential pressure sensor 63 which is provided in the DPF 1, with reference to FIG. 10 and FIG. 13 to FIG. 20. As shown in FIG. 13, the differential pressure sensor 63 is provided as the exhaust gas pressure sensor. The differential pressure sensor 63 is provided for detecting a pressure difference of the exhaust gas between the upstream side and the downstream side with reference to the soot filter 3 within the DPF 1. It is structured such that a piled-up amount of the particulate matter in the soot filter 3 is calculated on the basis of the pressure difference, and a clogged state within the DPF 1 can be comprehended. In other words, it is structured such that a regeneration control of the soot filter 3 can be automatically executed, for example, actuating accelerator control means or intake throttle control means which are not illustrated, on the basis of the pressure difference of the exhaust gas which is detected by the differential pressure sensor 63.

As shown in FIG. 13 to FIG. 19, a sensor bracket 66 is fastened by bolt to the inlet pinching flange 54 on the sound absorbing side, and the sensor bracket 66 is arranged in an upper surface side of the DPF casing 60. A detection main body 67 of the differential pressure sensor 63 is attached to the sensor bracket 66. An upstream side pipe joint body 64 and a downstream side pipe joint body 65 are connected to a detection main body 67 of the differential pressure sensor 63 via an upstream side sensor piping 68 and a downstream side sensor piping 69, respectively. A sensor boss body 113 is arranged, in the same manner as the sensor boss body 110, in the DPF casing 60. The upstream side pipe joint body 64 (the downstream side pipe joint body 65) is fastened to the sensor boss body 113 by a pipe joint bolt 114.

As shown in FIG. 10, FIG. 13 to FIG. 19, a sensor support portion 44 is integrally formed in a part of the inlet pinching flange 54 on the sound absorbing side, and the sensor bracket 66 is fastened to the sensor support portion 44 by a bolt 47. The inlet pinching flange 54 on the sound absorbing side (the flange body for attaching the exhaust gas purifying case) is detachably fastened to the outlet pinching flange 53 on the filter outlet side (the flange body for attaching the exhaust gas pressure sensor) via a bolt 42 and a nut 43. In other words, the sensor bracket 66 for attaching the exhaust gas pressure sensor is detachably provided on the sensor support portion 44, and the differential pressure sensor (the exhaust gas pressure sensor) 63 is arranged on the outer side surface of the filter outside case (the exhaust gas purifying case) 21.

Figure 15:
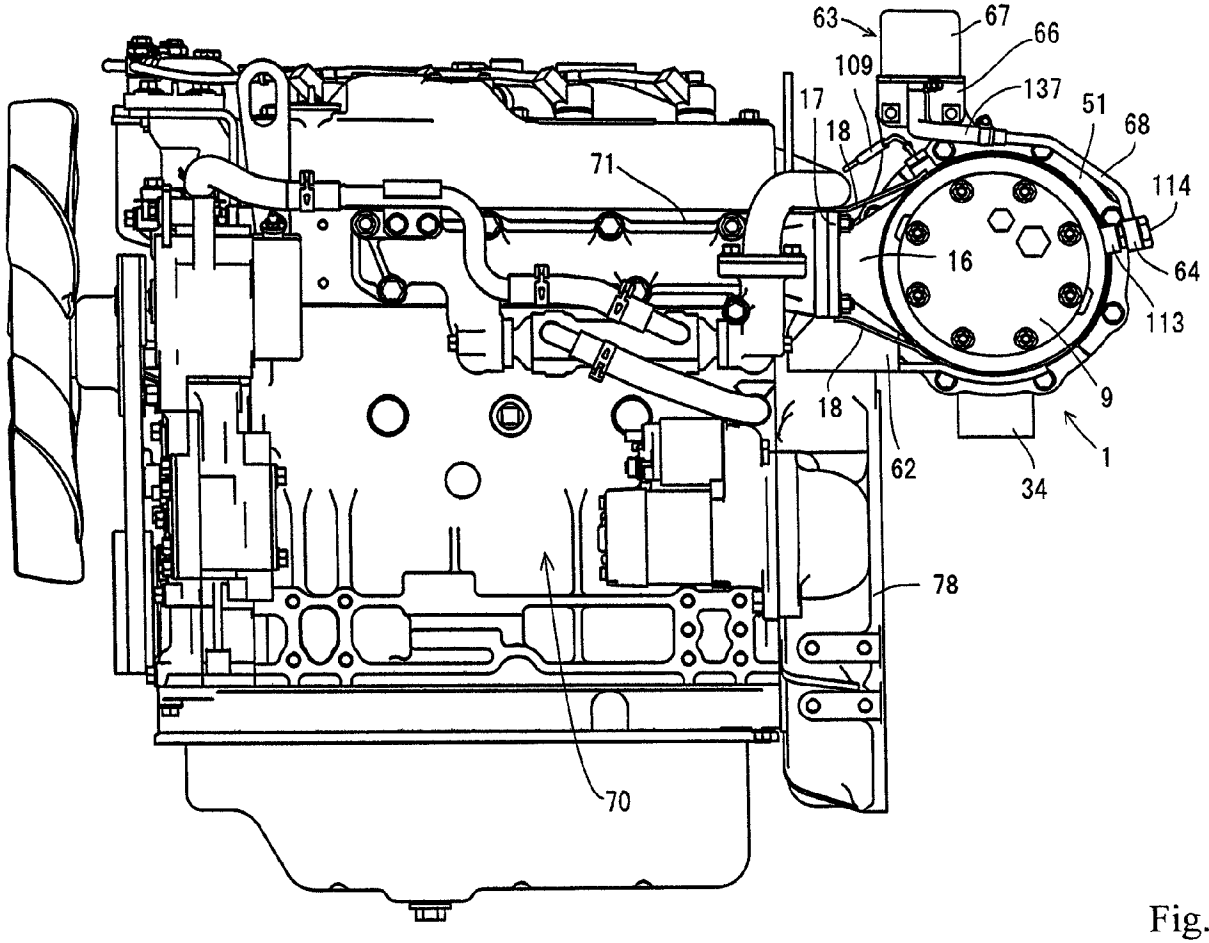
FIG. 15 is a left side view of the diesel engine which is provided with the DPF.
Figure 16:
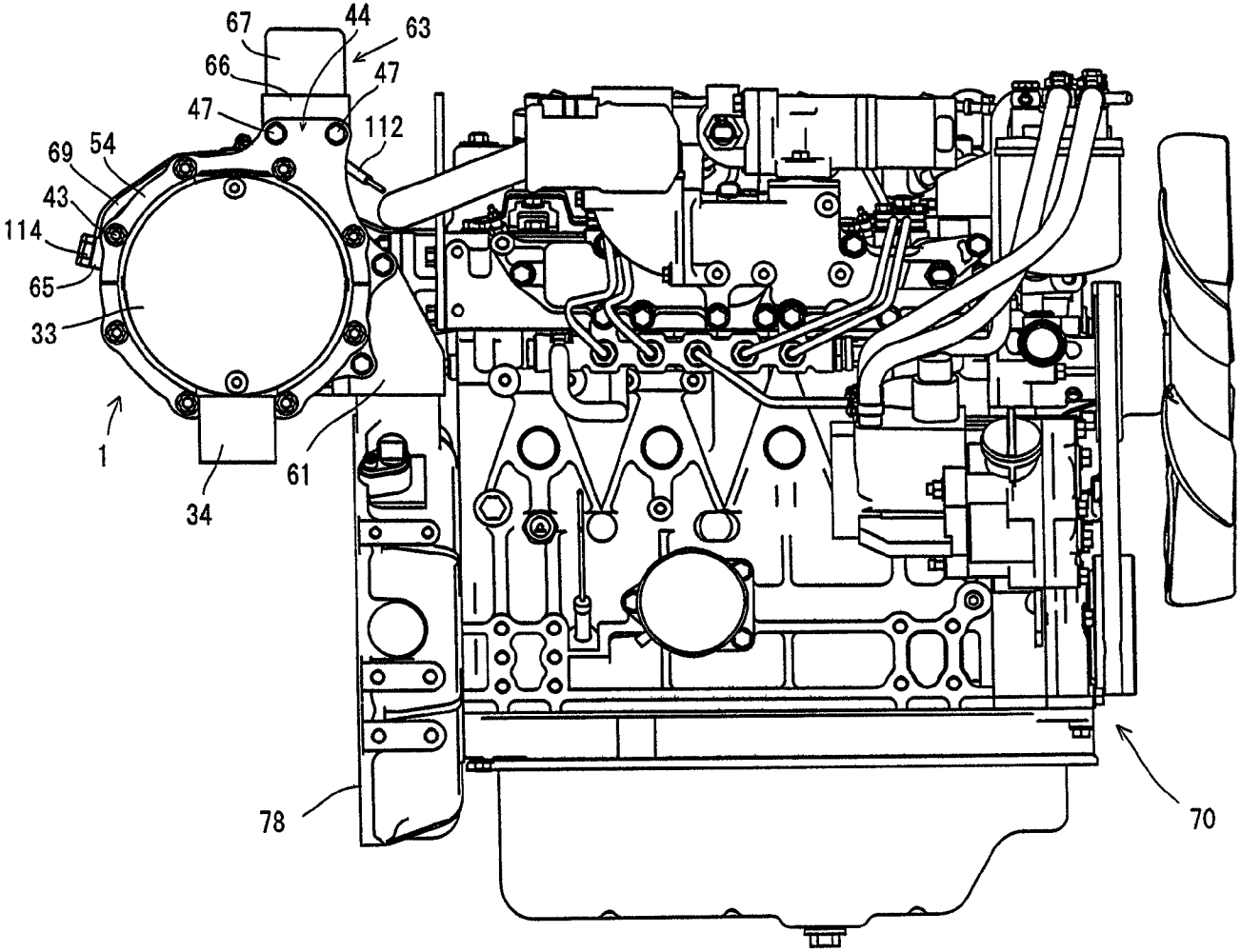
FIG. 16 is a right side view of the diesel engine which is provided with the DPF.
Figure 17:
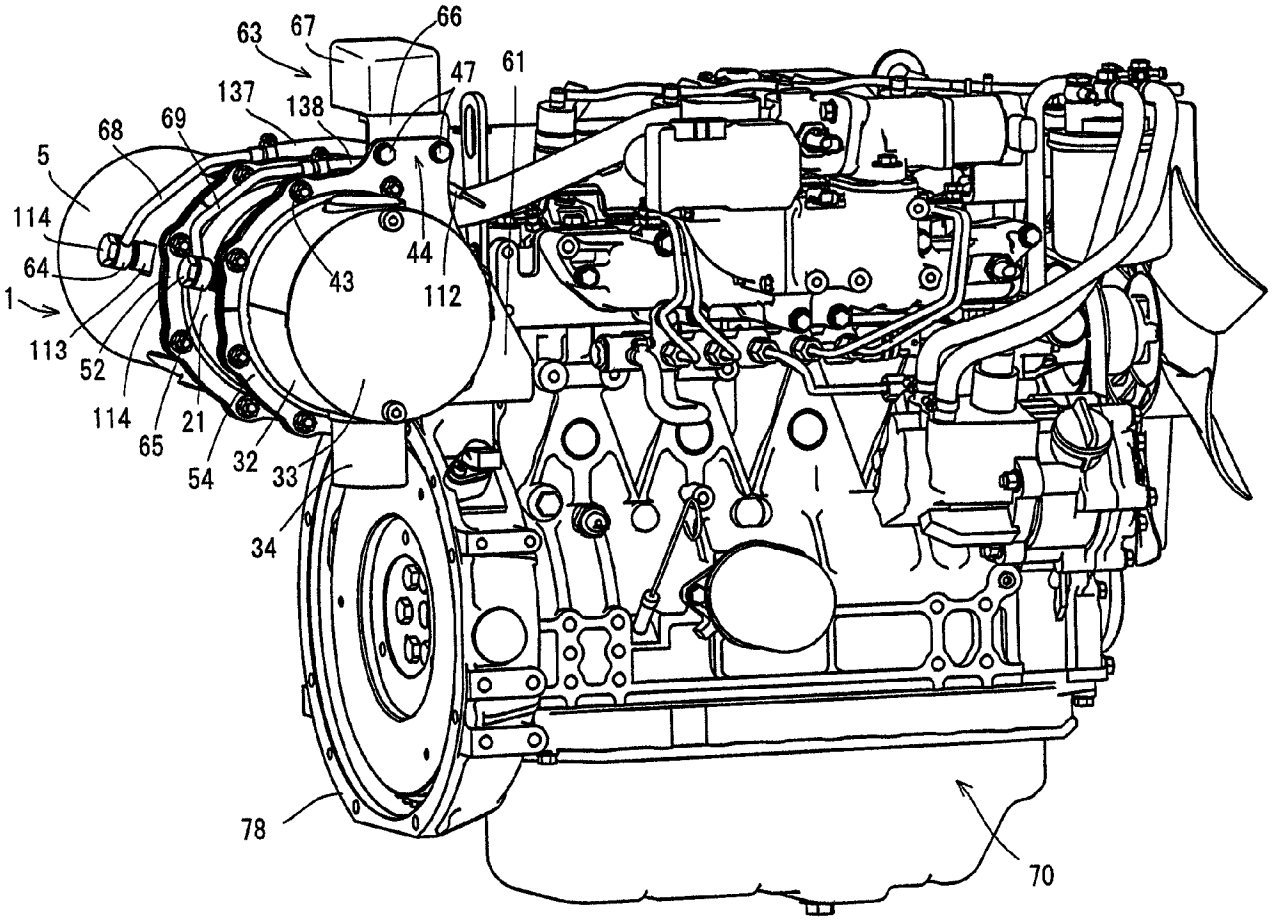
FIG. 17 is a back elevational perspective view of the diesel engine which is provided with the DPF.
Figure 18:
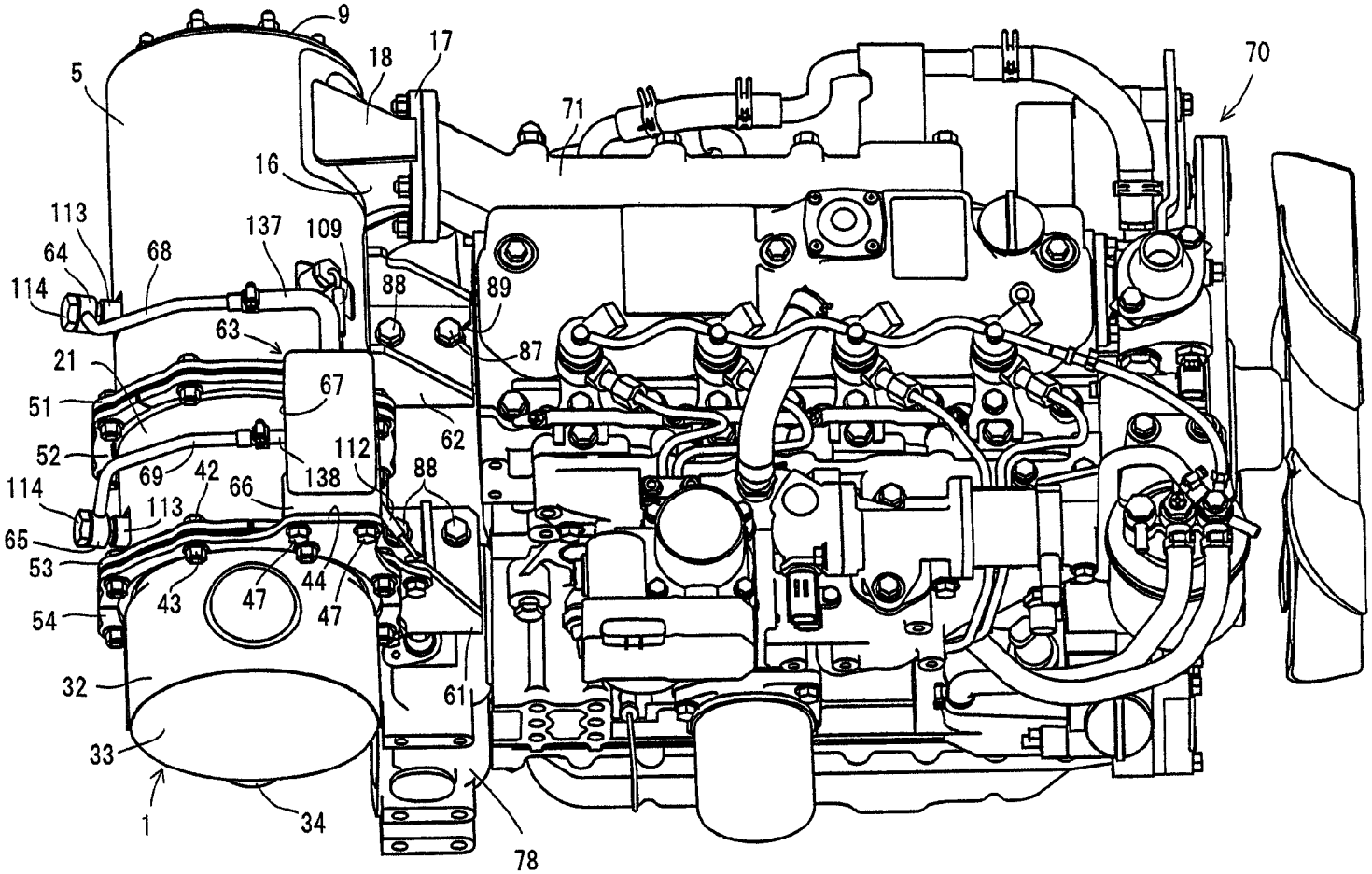
FIG. 18 is a plan perspective view of the diesel engine which is provided with the DPF.

As shown in FIG. 13, FIG. 15 and FIG. 19, the sensor boss body 113 serving as the sensor piping body is provided in the catalyst inside case 4 (or the filter inside case 20) serving as the exhaust gas purifying case. The upstream side pipe joint body 64 (or the downstream side pipe joint body 65) for connecting the sensor piping is fastened to the sensor boss body 113 via the pipe joint bolt 114, and the upstream side sensor piping 68 (or the downstream side sensor piping 69) made of a steel pipe is extended from the sensor boss body 113 toward the differential pressure sensor 67 serving as the exhaust gas pressure sensor, along the outer peripheral shape of the catalyst outside case 5 (or the filter outside case 21) serving as the exhaust gas purifying case. The differential pressure sensor 67 is connected to the upstream side sensor piping 68 (or the downstream side sensor piping 69) via an upstream side flexible pipe 137 (or a downstream side flexible pipe 138) made of a synthetic resin.

In accordance with the structure mentioned above, a difference (a differential pressure of the exhaust gas) between an exhaust gas pressure in an inflow side of the soot filter 3 and an exhaust gas pressure in an outflow side of the soot filter 3 is detected via the differential pressure sensor 67. Since a residual volume of a particulate matter in the exhaust gas which is collected by the soot filter 3 is in proportion to the differential pressure of the exhaust gas, a regeneration control (for example, a control for raising an exhaust temperature) for reducing a mass of the particulate matter of the soot filter 3 is executed on the basis of a result of detection of the differential pressure sensor 67, at a time when an amount of the particulate matter which remains in the soot filter 3 is increased to a predetermined amount or more. In the case that the residual volume of the particulate matter is further increased to a regeneration controllable range or more, there is carried out a maintenance work of attaching and detaching the DPF casing 60 so as to disassemble, cleaning the soot filter 3 and artificially removing the particulate matter.

As shown in FIG. 1, FIG. 13 and FIG. 18 to FIG. 21, in the exhaust gas purification device provided with the diesel oxidation catalyst 2 or the soot filter 3 which serves as the gas purifying body purifying the exhaust gas discharged by the diesel engine 70, and the gas purifying housing 60 (the catalyst inside case 4, the catalyst outside case 5, the filter inside case 20 and the filter outside case 21) which is provided with the diesel oxidation catalyst 2 or the soot filter 3 therein, the exhaust gas purification device is provided with the casing side bracket leg 62 serving as the support bracket which supports the DPF casing 60 serving as the gas purifying housing, and is structured such that the bolt through hole 87*a* is formed in the casing side bracket leg 62, the notch groove 89 serving as the insertion guide is formed in the casing side bracket leg 62, and the before attaching bolt 87 serving as the attaching bolt is engaged with and disengaged from the bolt through hole 87*a* via the notch groove 89.

Accordingly, the DPF casing 60 can be supported to the attaching position, by installing the before attaching bolt 87 for temporarily fixing in the pre-set state to the attaching position (the DPF attaching portion 80) in the diesel engine 70 side or the main machine side to which the casing side bracket leg 62 is connected, and thereafter engaging the bolt through hole 87*a* to the before attaching bolt 87 via the notch groove 89. In other words, the worker can fasten the casing side bracket leg 62 by fastening the attaching bolt 88 for the after attachment in a state of releasing hands from the DPF casing 60. It is possible to carry out the attaching and detaching work of the DPF casing 60 by one worker. It is possible to improve an assembling workability of the DPF casing 60 which is a heavy load.

As shown in FIG. 1, FIG. 13, and FIG. 18 to FIG. 21, it is structured such that the notch groove 89 is formed by a bolt inserting notch which is provided in the casing side bracket leg 62, the bolt through hole 87*a* is open to a side edge of the casing side bracket leg 62 via the notch groove 89, the bolt through hole 87*a* is engaged with the before attaching bolt 87 in the temporarily fixed state via the notch groove 89, and the DPF casing 60 (the gas purifying housing) can be supported via the before attaching bolt 87 in the temporarily fixed state.

Accordingly, the bolt through hole 87*a* can be engaged with the before attaching bolt 87 which is temporarily fixed in the pre-set state, via the notch groove 89. In other words, the worker can fasten the casing side bracket leg 62 by fastening the attaching bolt 88 for the after attachment in a state of releasing hands from the DPF casing 60. It is possible to carry out the attaching and detaching work of the DPF casing 60 by one worker. It is possible to improve an assembling workability of the DPF casing 60 which is a heavy load.

As shown in FIG. 1, FIG. 13 and FIG. 18 to FIG. 21, it is structured such that the catalyst outside case 5 or the filter outside case 21 which serves as the outside case body is fitted to the outer side of the catalyst inside case 4 or the filter inside case 20 which serves as the exhaust gas purifying case which is provided with the diesel oxidation catalyst 2 or the soot filter 3 therein, the DPF casing 60 serving as the gas purifying housing is formed by the catalyst inside case 4 or the filter inside case 20 and the catalyst outside case 5 or the filter outside case 21, and the casing side bracket leg 62 is firmly fixed integrally to the catalyst outside case 5 or the filter outside case 21. Accordingly, it is possible to easily achieve a thermal insulation of the catalyst inside case 4 or the filter inside case 20 and an improvement of a rigidity of the DPF casing 60, by the catalyst outside case 5 or the filter outside case 21.

As shown in FIG. 1, FIG. 13 and FIG. 18 to FIG. 21, it is structured such that plural sets of the purifying bodies (the diesel oxidation catalysts 2 or the soot filters 3), the exhaust gas purifying cases (the catalyst inside cases 4 or the filter inside cases 20) and the outside case bodies (the catalyst outside cases 5 or the filter outside cases 21) are provided, the catalyst side junction flange 25 or the filter side junction flange 26 serving as the flange body for connecting the plurality of catalyst outside cases 5 or filter outside cases 21 is offset with respect to the connection boundary position of the plurality of diesel oxidation catalysts 2 or soot filters 3, and the casing side bracket leg 62 is firmly fixed integrally to any one of the plurality of catalyst outside cases 5 or filter outside cases 21.

Accordingly, it is possible to simplify a disassembling and assembling work of the diesel oxidation catalyst 2 or the soot filter 3 and the catalyst inside case 4 or the filter inside case 20. It is possible to easily prevent the exhaust gas leakage or the like by the catalyst side junction flange 25 or the filter side junction flange 26 while it is possible to improve a maintenance workability of a soot clogging removal of the soot filter 3 or the like.

As shown in FIG. 1, FIG. 13 and FIG. 18 to FIG. 21, it is structured such that the plural sets of the diesel oxidation catalysts 2 or the soot filters 3, the catalyst inside cases 4 or the filter inside cases 20 and the catalyst outside cases 5 or the filter outside cases 21 are provided, the catalyst side junction flange 25 or the filter side junction flange 26 for connecting the plurality of catalyst outside cases 5 or filter outside cases 21 is offset with respect to the connection boundary position of the plurality of diesel oxidation catalysts 2 or soot filters 3, and the casing side bracket leg 62 in which the notch groove 89 is formed is firmly fixed to the catalyst outside case 5 in a side in which a dimension in an exhaust gas moving direction is longer, in the plurality of catalyst outside cases 5 or filter outside cases 21.

Accordingly, it is possible to simplify a disassembling and assembling work of the diesel oxidation catalyst 2 or the soot filter 3 and the catalyst inside case 4 or the filter inside case 20. It is possible to easily prevent the exhaust gas leakage or the like by the catalyst side junction flange 25 or the filter side junction flange 26 while it is possible to improve a maintenance workability of a soot clogging removal of the diesel oxidation catalyst 2 or the soot filter 3 or the like. Further, it is possible to assemble the casing side bracket leg 62 in which the notch groove 89 is formed with a high rigidity by utilizing the catalyst outside case 5 which is formed longer.

As shown in FIG. 1, FIG. 13 and FIG. 18 to FIG. 21, it is structured such that the plural sets of the diesel oxidation catalysts 2 or the soot filters 3, the catalyst inside cases 4 or the filter inside cases 20 and the catalyst outside cases 5 or the filter outside cases 21 are provided, the catalyst side junction flange 25 or the filter side junction flange 26 for connecting the plurality of catalyst outside cases 5 or filter outside cases 21 is offset with respect to the connection boundary position of the plurality of gas purifying bodies, and the casing side bracket leg 62 in which the notch groove 89 is formed is firmly fixed to the catalyst outside case 5 which is provided with the exhaust gas inlet pipe 16, in the plurality of catalyst outside cases 5 or filter outside cases 21.

Accordingly, it is possible to simplify a disassembling and assembling work of the diesel oxidation catalyst 2 or the soot filter 3 and the catalyst inside case 4 or the filter inside case 20. It is possible to easily prevent the exhaust gas leakage or the like by the catalyst side junction flange 25 or the filter side junction flange 26 while it is possible to improve a maintenance workability of a soot clogging removal of the diesel oxidation catalyst 2 or the soot filter 3 or the like. Further, it is possible to assemble the casing side bracket leg 62 in which the notch groove 89 is formed, and the exhaust gas inlet pipe 16, with a high rigidity by utilizing the catalyst outside case 5 which is formed longer.

REFERENCE SIGNS LIST

2 Diesel oxidizing catalyst (gas purifying body)
3 Soot filter (gas purifying body)

4 Catalyst inside case
5 Catalyst outside case
16 Exhaust gas inlet pipe
20 Filter inside case (exhaust gas purifying case)
21 Filter outside case (exhaust gas purifying case)
25 Catalyst side junction flange (flange body)
26 Filter side junction flange (flange body)
60 DPF casing (gas purifying housing)
62 Casing side bracket leg (support bracket)
70 Diesel engine
80 DPF attaching portion
87 Attaching bolt
87*a* Bolt hole
89 Insertion guide

The invention claimed is:

1. An exhaust gas purification device comprising:

a gas purifying body which purifies an exhaust gas discharged by an engine; and a gas purifying housing which is provided with the gas purifying body therein, wherein the exhaust gas purification device has a structure provided with a support bracket which supports the gas purifying housing, and is configured such that a bolt hole is formed in the support bracket, an insertion guide is formed by a bolt inserting notch which is provided in the support bracket, the bolt hole is left open at a side edge of the support bracket via the bolt inserting notch, and a first attaching bolt is engaged with and disengaged from the bolt hole via the insertion guide, wherein an exhaust gas inlet pipe, which allows exhaust gas to flow from the engine into the gas purifying housing, is provided on an outside face of the gas purifying housing, and an inlet flange body is provided on an end of an exhaust gas inlet-side opening of the exhaust gas inlet pipe for bolt-fastening the inlet flange body with the exhaust side of the engine by a second attaching bolt, wherein an engagement-disengagement directional axis along which the first insertion bolt engages and disengages with the insertion guide is parallel to a direction by which the second attaching bolt bolt-fastens the inlet flange body with the exhaust side of the engine;

wherein said insertion guide, said inlet flange body, said second attaching bolt, and said parallel direction and directional axis are configured so that when the first attaching bolt is positioned in engagement along the insertion guide at the bolt hole, the support bracket supports the exhaust gas purification device on the engine prior to completion of bolting by the first attaching bolt and bolt-fastening by the second attaching bolt thereby allowing by presence of said support easier completion of said bolting and bolt-fastening during installation, and so that when the first attaching bolt is positioned in engagement with the insertion guide upon unbolting and removal of the bolt-fastening during maintenance said support remains thereby allowing maintenance to be performed without complete uninstallation; and wherein said directional axis is parallel to the direction of movement of the exhaust gas when the exhaust gas moves from the engine toward the exhaust gas inlet pipe, and wherein the bolt hole is engaged with the attaching bolt via the bolt inserting notch, and the gas purifying housing is supported via the first attaching bolt.

2. The exhaust gas purification device according to claim 1, wherein an outside case body is fitted to an outer side of an exhaust gas purifying case which is provided with the gas purifying body therein, the gas purifying housing is formed by the exhaust gas purifying case and the outside case body, and the support bracket is firmly fixed to the outside case body integrally.

3. The exhaust gas purification device according to claim 2, wherein plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket is firmly fixed to at least any one of the plurality of outside case bodies integrally.

4. The exhaust gas purification device according to claim 2, wherein plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket in which the insertion guide is formed is firmly fixed to the outside case body in a side in which a dimension in an exhaust gas moving direction is longer, in the plurality of outside case bodies.

5. The exhaust gas purification device according to claim 2, wherein plural sets of the gas purifying bodies, the exhaust gas purifying cases and the outside case bodies are provided, a flange body for connecting the plurality of outside case bodies is offset with respect to a connection boundary position of the plurality of the gas purifying bodies, and the support bracket in which the insertion guide is formed is firmly fixed to the outside case body in which an exhaust gas inlet pipe is provided, in the plurality of outside case bodies.

* * * * *